US006807281B1

(12) United States Patent
Sasaki et al.

(10) Patent No.: US 6,807,281 B1
(45) Date of Patent: Oct. 19, 2004

(54) LOUDSPEAKER AND METHOD OF DRIVING THE SAME AS WELL AS AUDIO SIGNAL TRANSMITTING/RECEIVING APPARATUS

(75) Inventors: Toru Sasaki, Tokyo (JP); Kaoru Gyotoku, Kanagawa (JP); Kohei Asada, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/380,816

(22) PCT Filed: Dec. 28, 1998

(86) PCT No.: PCT/JP98/06008

§ 371 (c)(1),
(2), (4) Date: Sep. 8, 1999

(87) PCT Pub. No.: WO99/35881

PCT Pub. Date: Jul. 15, 1999

(30) Foreign Application Priority Data

Jan. 9, 1998 (JP) ..... 10-003483
Nov. 30, 1998 (JP) ..... 10-340706

(51) Int. Cl.[7] ..... H04R 3/00
(52) U.S. Cl. ..... 381/111; 381/77
(58) Field of Search ..... 381/111, 77, 79, 381/82; 367/92

(56) References Cited

U.S. PATENT DOCUMENTS 5,159,703 A * 10/1992 Lowery ..... 381/73.1

OTHER PUBLICATIONS

Mitchell et al; Introduction to Electronics Design; 1988; p. 526.*

* cited by examiner

*Primary Examiner*—Ping Lee
(74) *Attorney, Agent, or Firm*—Jay H. Maioli

(57) ABSTRACT

A loudspeaker apparatus includes a modulator for frequency-modulating an audio signal to a signal of a frequency band and an ultrasonic generating device adapted to be driven by the output signal of the modulator. The modulator frequency-modulates the audio signal into a first signal modulated on the basis of a an ultrasonic frequency and a source signal and a second signal modulated on the basis of the ultrasonic second frequency and an inverted version of the source signal. As the ultrasonic generating device is driven by the modulated signals, it emits an ultrasonic wave of a first frequency and an ultrasonic wave of a second frequency and the frequency component corresponding to the difference of the two frequencies provides audible sound. Since the ultrasonic generating device emits ultrasonic waves, an ultradirectivity can be realized.

35 Claims, 15 Drawing Sheets

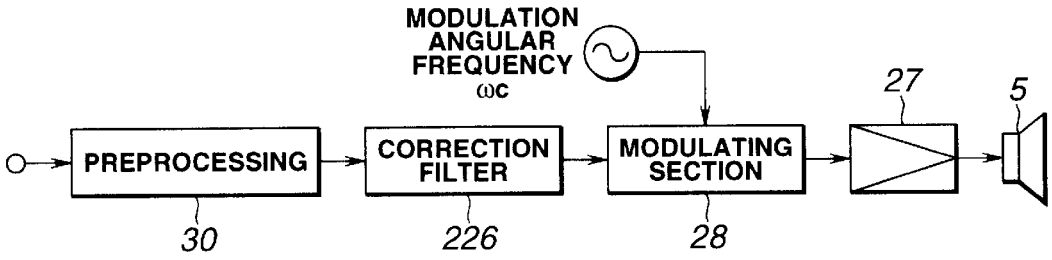
FIG.13
FIG.14A MODULATION INPUT (PREPROCESSING OUTPUT)
FIG.14B MODULATION OUTPUT
FIG.14C LOUDSPEAKER CHARACTERISTIC
FIG.14D LOUDSPEAKER CHARACTERISTIC NEAR k = 0 (AUDIO BAND)
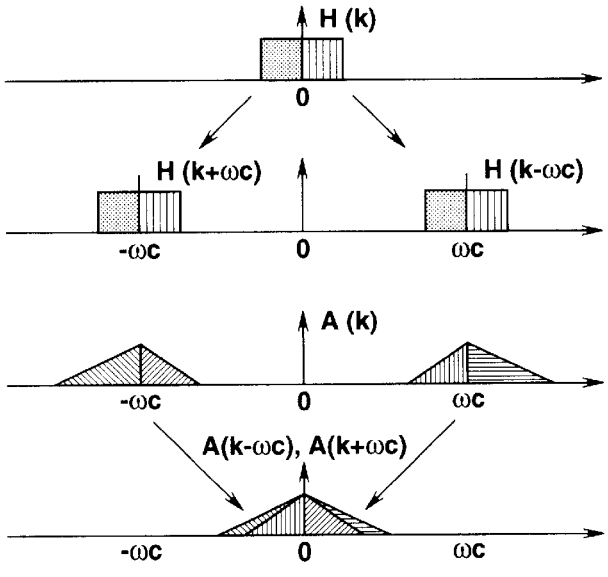

LOUDSPEAKER AND METHOD OF DRIVING THE SAME AS WELL AS AUDIO SIGNAL TRANSMITTING/RECEIVING APPARATUS

TECHNICAL FIELD

This invention relates to a loudspeaker apparatus adapted to reproduce audio signals by means of an ultrasonic generating device and a method of driving such a loudspeaker apparatus. It also relates to an audio signal transmitter comprising an ultrasonic generating device.

BACKGROUND ART

Loudspeaker apparatus comprising a diaphragm to be oscillated to emit sounds into air and hence to listeners are being popularly used. Loudspeaker apparatus of this type are normally adapted to make the diaphragm to be oscillated by audio signals of an audible band between 20 Hz and 20 KHz so as to emit sound waves directly into air.

More specifically, sound is emitted into air from the diaphragm of a loudspeaker apparatus that is adapted to make the diaphragm to be oscillated by audio signals of an audible band so that the emitted sound is spread, or propagated, through air from the diaphragm that operates as the center of propagation. Such a loudspeaker apparatus is useful for emitting sound into a large space.

However, such a loudspeaker apparatus cannot be used to emit sound to one or more than one specific listeners.

Headphones and earphones are used to allow individuals to listen to a reproduced sound. Such headphones and earphones also comprise a diaphragm that is oscillated by audio signals of an audible band and the sound emitted from the diaphragm is spread into air. A headphone set or an earphone set has to be borne by the head or the ears, whichever appropriate, of the user with the loudspeaker units of the set held in a closed state so that the listener may hear the reproduced sound secretly.

DISCLOSURE OF THE INVENTION

It is an object of the present invention to provide a loudspeaker apparatus adapted to ultradirectionally emit sound by means of a novel drive system and a method of driving such a loudspeaker apparatus.

Another object of the present invention is to provide a loudspeaker apparatus adapted to secretly emit sound and a method of driving such a loudspeaker apparatus.

Still another object of the present invention is to provide a loudspeaker apparatus adapted to emit different sounds that can be heard at respective different locations and a method of driving such a loudspeaker apparatus.

Still another object of the present invention is to provide a loudspeaker apparatus that can set up a phone source at any location and a method of driving such a loudspeaker apparatus.

A further object of the present invention is to provide an audio signal transmitting/receiving apparatus adapted to transmit and receive audio signals with an increased degree of secrecy.

According to an aspect of the invention, the above objects and other objects are achieved by providing a loudspeaker apparatus comprising a modulator for frequency-modulating an audio signal to a signal of a frequency band at least higher than the audible frequency band and at least an ultrasonic generating device adapted to be driven by the output signal of said modulator.

Said modulator frequency-modulates said audio signal into a first signal frequency-modulated on the basis of a first frequency and a second signal frequency-modulated on the basis of a second frequency different from the first frequency.

Preferably, a loudspeaker apparatus according to the invention comprises a plurality of ultrasonic generating devices, said first signal being supplied to part of said plurality of ultrasonic generating devices, said second signal being supplied to the rest of said plurality of ultrasonic generating devices.

Preferably, a loudspeaker apparatus according to the invention further comprises a differential processing section for differentiating said audio signal and said modulator includes a first modulating section and a second modulating section, the output signal of said differential processing section being supplied to either said first or said second modulating section, a signal obtained by inverting the polarity of said output signal of said differential processing section being supplied to the other modulating section.

Preferably, a loudspeaker apparatus according to the invention further comprises a first circuit section for supplying a signal obtained by shifting the DC level of said output signal from said differential processing section to either said first or said second modulating section and a second circuit section for supplying a signal obtained by inverting the polarity and shifting the DC level of said output signal from said differential processing section to the other modulating section.

Preferably, a loudspeaker apparatus according to the invention further comprises a preprocessing circuit for preprocessing said audio signal and said modulator includes a first modulating section for amplitude-modulating the output signal of said preprocessing circuit, using the output signal of said first modulating section as a carrier wave, and a second modulating section for amplitude-modulating the output signal of said preprocessing circuit, using the output signal of said second modulating section as a carrier wave.

Preferably, a loudspeaker apparatus according to the invention further comprises a correction filter arranged between said modulator and said ultrasonic generating device. Said correction filter suppresses the resonance frequency components of the ultrasonic generating device out of said output signal of said modulator.

According to the invention, there is also provided a loudspeaker apparatus comprising a modulator including a first modulating section and a second modulating section, either said first or said second modulating section being adapted to be supplied with an audio signal, the other modulating section being adapted to be supplied with a signal obtained by inverting said audio signal, said audio signal being frequency-modulated into a signal of a frequency band at least higher than the audible frequency band, and an ultrasonic generating section adapted to be driven by the output signal of said modulator, said ultrasonic generating device including a first generating section comprising a plurality of ultrasonic generating devices adapted to be driven by the output signal of said first modulating section and a second generating section comprising a plurality of ultrasonic generating devices adapted to be driven by the output signal of said second modulating section.

According to another aspect of the invention, there is also provided an audio signal transmitting/receiving apparatus comprising a modulator for frequency-modulating a carrier wave by a signal obtained by differentiating an audio signal, an ultrasonic generating section adapted to be driven by the output signal of said modulator, a microphone for detecting the sound wave output from said ultrasonic generating section and an arithmetic section for arithmetically processing the output signal of said microphone by using an inverse cosine function.

Preferably, in an audio signal transmitting/receiving apparatus according to the invention, said microphone detects the sound wave of the audible frequency band output from said ultrasonic generating section.

According to still another aspect of the invention, there is provided a method of driving a loudspeaker apparatus comprising at least an ultrasonic generating device, said method comprising a step of frequency-modulating the input audio signal into a signal of a frequency band at least higher than the audible frequency band and a subsequent step of driving the ultrasonic generating device by said signal obtained by frequency-modulation.

In a method of driving a loudspeaker apparatus according to the invention, said audio signal is frequency-modulated into a first signal on the basis of a first frequency and a second signal on the basis of a second frequency different from said first frequency in said frequency-modulating step.

The above and other objects and the advantages of the invention will become apparent from the following description to be made by referring to the accompanying drawings that illustrate preferred embodiments of the invention.

BRIEF DESCRIPTION OF THE DRAWINGS

FIG. 13 is a schematic block diagram of a loudspeaker apparatus according to the invention and comprising a correction filter, showing another possible circuit configuration thereof.

FIG. 14 is a schematic illustration of the principle of operation of a correction filter for correcting the characteristics of a loudspeaker apparatus in the audio frequency band.

BEST MODE FOR CARRYING OUT THE INVENTION

Now, a loudspeaker apparatus, a method of driving the same and an audio signal transmitting/receiving apparatus comprising the same according to the invention will be described by referring to the accompanying drawings that illustrate preferred embodiments of the invention.

First, the basic circuit configuration of a loudspeaker apparatus according to the invention will be described by referring to FIG. 1.

Figure 1:
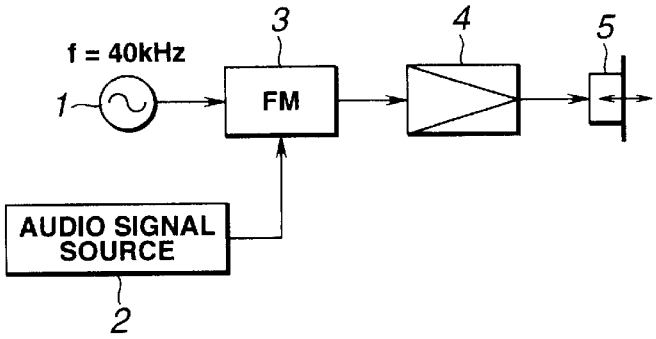
FIG. 1 is a schematic circuit diagram of a loudspeaker apparatus according to the invention, showing the basic circuit configuration thereof.

As shown in FIG. 1, the loudspeaker apparatus comprises a carrier wave oscillator 1 for generating a carrier wave with a predetermined frequency, an audio signal source 2 for producing an audio signal, a frequency modulator 3 for frequency-modulating the carrier wave from the carrier wave oscillator 1 by means of the audio signal from the audio signal source 2 and an ultrasonic generator 5 adapted to be driven by the carrier wave (to be referred to as frequency-modulated signal hereinafter) that has been frequency-modulated and produced from the frequency modulator 3.

The carrier wave oscillator 1 supplies a carrier wave with a predetermined frequency such as a 40 kHz carrier wave to the frequency modulator 3. The audio signal source 2 typically comprises an optical disk player or a tape recorder and supplies an audio signal to the frequency modulator 3 as modulation signal. The frequency modulator 3 frequency-modulates the carrier wave input from the carrier wave oscillator 1 by means of the modulation signal from the audio signal source 2. The frequency-modulated signal is then input to the ultrasonic generator 5 by way of an amplifier 4. The ultrasonic generator 5 typically comprises at least an ultrasonic generating device and shows a very high directivity (to be referred to as ultradirectivity described hereinafter) so that, as it is driven by the frequency-modulated signal that has been amplified by the amplifier 4, it emits an ultrasonic wave in the direction of the axis of the ultrasonic generator 5 according to the frequency-modulated signal with the ultradirectivity specific to it. Then, the user to which the ultrasonic generator 5 is directed can hear a sound corresponding to the audio signal from the audio signal source 2. If the ultrasonic generator is directed to a wall, he or she will feel that as if the wall is emitting sound.

Now, the fundamental principle underlying the fact that, when an ultrasonic wave is emitted from an ultrasonic generator driven by an audio signal from an audio signal source according to a frequency-modulated signal that has been frequency-modulated, a sound corresponding to the original audio signal is heard will be briefly described below.

If a system has a non-linearlity of the degree of an even number as expressed by formula (1) and a signal comprising two frequency components ($w_1/2\pi$, $w_2/2\pi$) as expressed by formula (2) is input, a difference frequency distortion as expressed by formula (3) is generated as a sort of cross modulation distortion.

$$y=Ax+Bx^2 \tag{1}$$

where x is the input signal of the system and y is the output signal of the system.

$$x=f_1 \cos \omega_1 t+f_2 \cos \omega_2 t \tag{2}$$

Thus, formula (3) is obtained by substituting x in formula (1) with formula (2).

$$\begin{aligned} y=&A(f_1 \cos \omega_1 t+f_2 \cos \omega_2 t)+\\ &B/2(f_1^2+f_2^2)+\\ &B/2(f_1^2 \cos 2\omega_1 t+f_2^2 \cos 2\omega_2 t)+\\ &B(f_1 f_2 \cos(w_1-w_2)t)+\\ &B(f_1 f_2 \cos(w_1+w_2)t) \end{aligned} \tag{3}$$

The first term on the right side of the formula (3) represents the fundamental wave component and the second term represents the DC component, whereas the third term represents the second higher harmonic component and the fourth term represents the difference frequency component, the fifth term representing the sum frequency component. The difference frequency component of the fourth term is equal to the difference frequency distortion and a frequency component (difference sound) corresponding to the frequency difference ($w_1-w_2$) appears on the output of the system. For example, when an ultrasonic generator is driven by mixed two sine wave signals of 40 KHz and 41 KHz that are output from two carrier wave oscillators, a difference sound of 1 KHz corresponding to the difference frequency distortion will be heard.

On the other hand, as well known, a frequency-modulated signal contains an infinite number of side waves on both sides of the carrier wave. Therefore, if air has a non-linearity of the degree of an even number relative to an ultrasonic wave, the original audio signal is reproduced and the user can hear a sound corresponding to the reproduced audio signal.

Now, a specific example of circuit configuration of a loudspeaker apparatus according to the invention and realized on the above principle will be described by referring to FIG. 2.

Note that the component circuits functionally same as those of the loudspeaker apparatus of FIG. 1 are denoted by the same reference symbols and will not be described any further.

Figure 2:
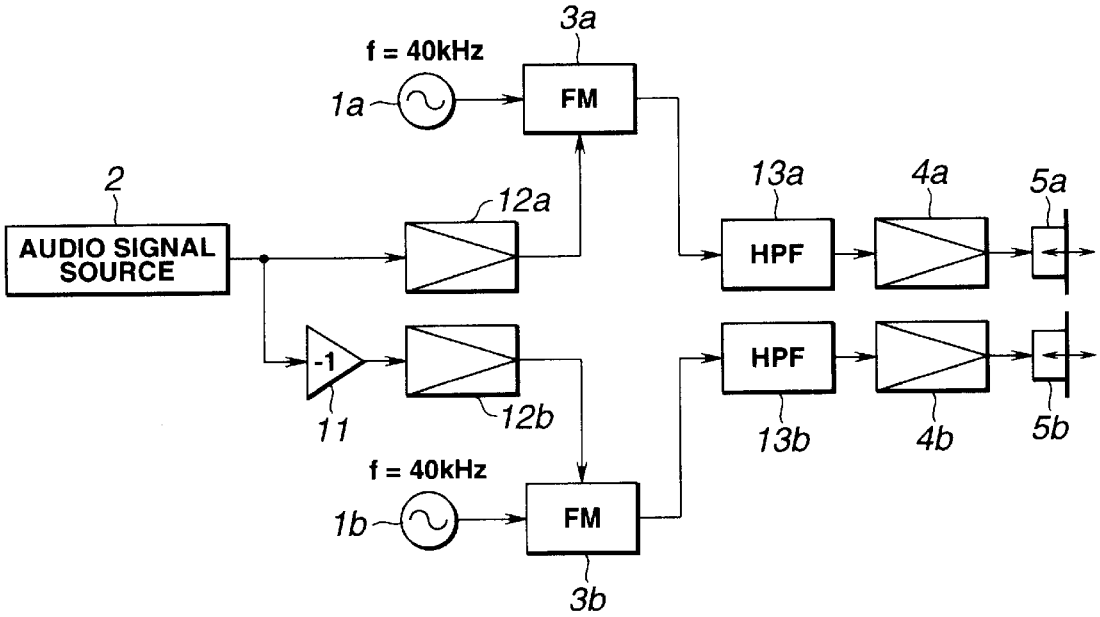
FIG. 2 is a schematic circuit diagram of an embodiment of a loudspeaker apparatus according to the invention.

As shown in FIG. 2, the loudspeaker apparatus comprises first and second carrier wave oscillators 1*a*, 1*b* for generating respective carrier waves with respective predetermined frequencies, an audio signal source 2 for producing an audio signal, first and second frequency-modulators 3*a*, 3*b* for frequency-modulating the carrier waves from the first and second carrier wave oscillators 1*a*, 1*b* respectively by means of the audio signal from sound source 2 and an audio signal obtained by inverting the above audio signal and first and second ultrasonic generators 5*a*, 5*b* adapted to be driven respectively by the frequency-modulated signals output from the first and second frequency-modulators 3*a*, 3*b*.

The first and second carrier wave oscillators 1*a*, 1*b* supply carrier waves of, for example, 40 KHz respectively to the first and second frequency-modulators 3*a*, 3*b*. The audio signal source 2 supplies an audio signal as modulation signal to the frequency-modulator 3*a* by way of a first amplifier 12*a* and also an audio signal obtained by inverting the amplitude of the audio signal from the audio signal source 2 as modulation signal to the second frequency-modulator 3*b* by way of a second amplifier 12*b*. The first and second frequency-modulators 3*a*, 3*b* frequency-modulate the carrier waves input from the first and second carrier wave oscillators 1*a*, 1*b* respectively by means of the modulation signals amplified by the first and second amplifiers 12*a*, 12*b*. The obtained frequency-modulated signals are then input respectively to first and second high-pass filters 13*a*, 13*b* with a cut-off frequency of, for example, 20 KHz where the frequency components under 20 KHz are removed therefrom and then input to the first and second ultrasonic generators 5*a*, 5*b* by way of respective amplifiers 4*a*, 4*b*. Each of the first and second ultrasonic generators 5*a*, 5*b* comprises at least an ultrasonic generating device. They are driven respectively by the frequency-modulated signals that have been amplified by the first and second amplifiers 4*a*, 4*b* respectively and emit carrier waves in the respective directions of the first and second ultrasonic generators 5*a*, 5*b* according to the frequency-modulated signals with the ultradirectivities specific to them.

The first and second ultrasonic generators 5*a*, 5*b* are typically configured in a manner as described below.

Figure 3:
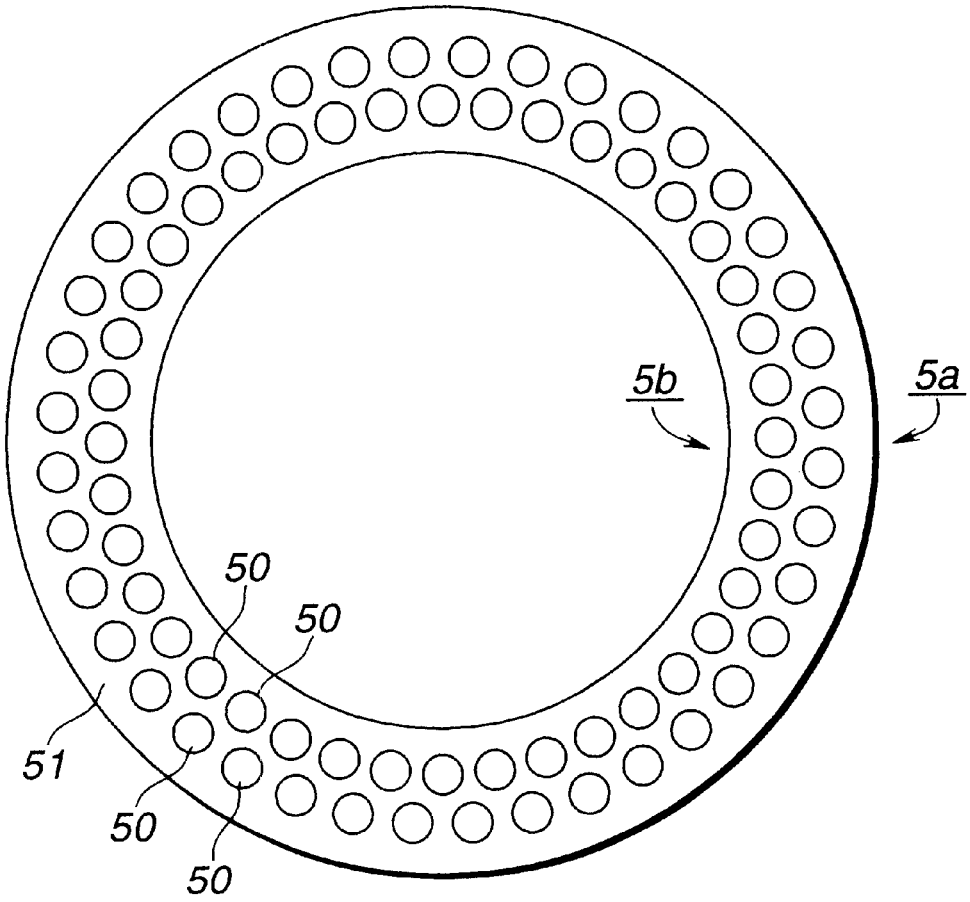
FIG. 3 is a schematic plan view of the ultrasonic generators of a loudspeaker apparatus according to the invention, showing a possible arrangement thereof.

Each of the first and second ultrasonic generators 5*a*, 5*b* comprises a plurality of ultrasonic generating devices that are piezoelectric devices 50, the number of which may be, for example, 37. FIG. 3 shows a possible arrangement of the piezoelectric devices that can be used for the purpose of the invention, where the piezoelectric devices 50 of the first ultrasonic generator 5*a* are arranged annularly along the inner periphery of a support substrate 51 and the piezoelectric devices 50 of the second ultrasonic generator 5*b* are arranged annularly to surround the piezoelectric devices 50 of the first ultrasonic generator 5*a*. Note that the circle defined by the piezoelectric devices 50 of the first ultrasonic generator 5*a* arranged annularly along the inner periphery of the substrate and the circle defined by the piezoelectric devices 50 of the second ultrasonic generator 5*b* arranged annularly along the outer periphery of the substrate are coaxial relative to each other.

When the ultradirectional first and second ultrasonic generators 5*a*, 5*b* are directed to the user, the latter can hear the sound corresponding to the audio signal from the audio signal source 2. Since the first and second ultrasonic generators 5*a*, 5*b* are driven by two frequency-modulated signals, one frequency-modulated by the audio signal and one frequency-modulated by a signal obtained by inverting the polarity of the audio signal, and hence they emit ultrasonic waves differentially, the user can hear a sound louder than the sound he or she hears from the loudspeaker apparatus of FIG. 1. Additionally, the sound pressure will be raised as groups of a plurality of piezoelectric devices 50 are used.

While the above described loudspeaker apparatus comprises two groups of piezoelectric devices 50, it may alternatively be so arranged that the loudspeaker apparatus comprises only a group of piezoelectric devices 50 that are driven by a signal obtained by mixing the frequency-modulated signals by means of a mixer.

Figure 4:
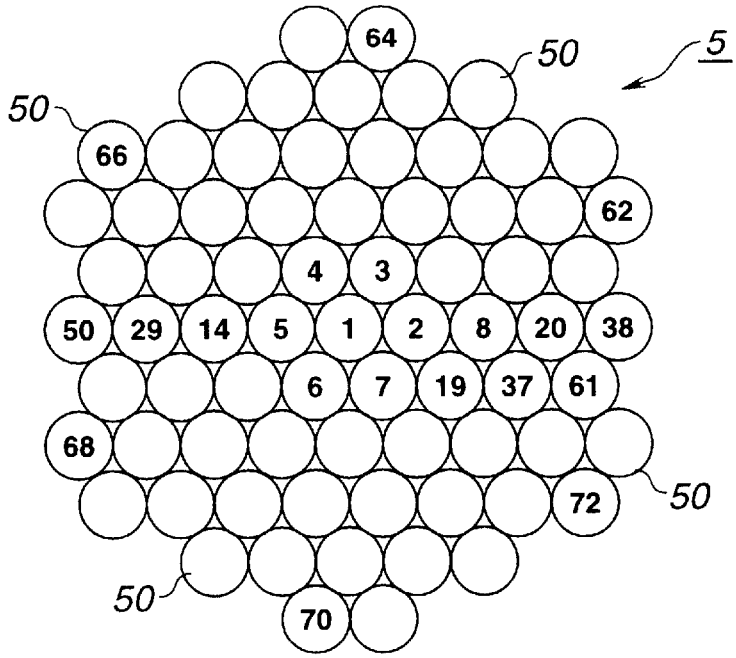
FIG. 4 is a schematic plan view of the ultrasonic generators of a loudspeaker apparatus according to the invention, showing another possible arrangement thereof.
Figure 5:
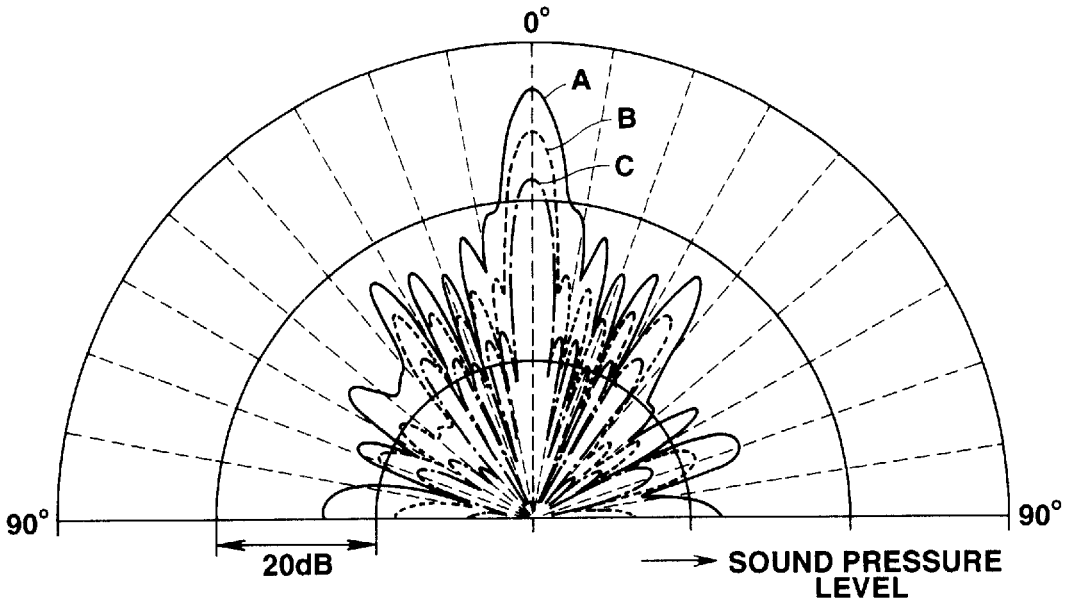
FIG. 5 is a chart illustrating the directional characteristics of the loudspeaker apparatus of FIG. 4.

If such is the case, a plurality of cylinder-shaped piezoelectric devices 50 may be arranged concentratedly as shown in FIG. 4, where a total of 73 piezoelectric devices are used. A loudspeaker apparatus comprising an ultrasonic generator 5 realized by concentratedly arranging a plurality of piezoelectric devices 50 show a directional characteristic as indicated by A in FIG. 5 at a point separated by 0.5 m from the loudspeaker apparatus, one as indicated by B in FIG. 5 at a point separated by 1 m from the apparatus and one as indicated by C in FIG. 5 at a point separated by 2 m from the apparatus. Thus, it will be seen that the loudspeaker apparatus is strongly directed to the front thereof.

Still alternatively, the ultrasonic generator 5 of FIG. 4 may be so configured that it comprises several groups of a plurality of ultrasonic generating devices (piezoelectric devices 50) so that a frequency-modulated signal is input to the ultrasonic generating devices of each of the groups to drive the ultrasonic generator 5. If such is the case, it will be appreciated that the ultrasonic generators 5*a*, 5*b* of the loudspeaker apparatus of FIG. 2 are realized by preparing two groups of a plurality of ultrasonic generating devices.

Now, another embodiment of loudspeaker apparatus according to the invention will be described by referring to FIG. 6. Note that the component circuits of this embodiment that are functionally the same as those of the embodiment of FIG. 2 are denoted respectively by the same reference symbols and will not be described any further.

Figure 6:
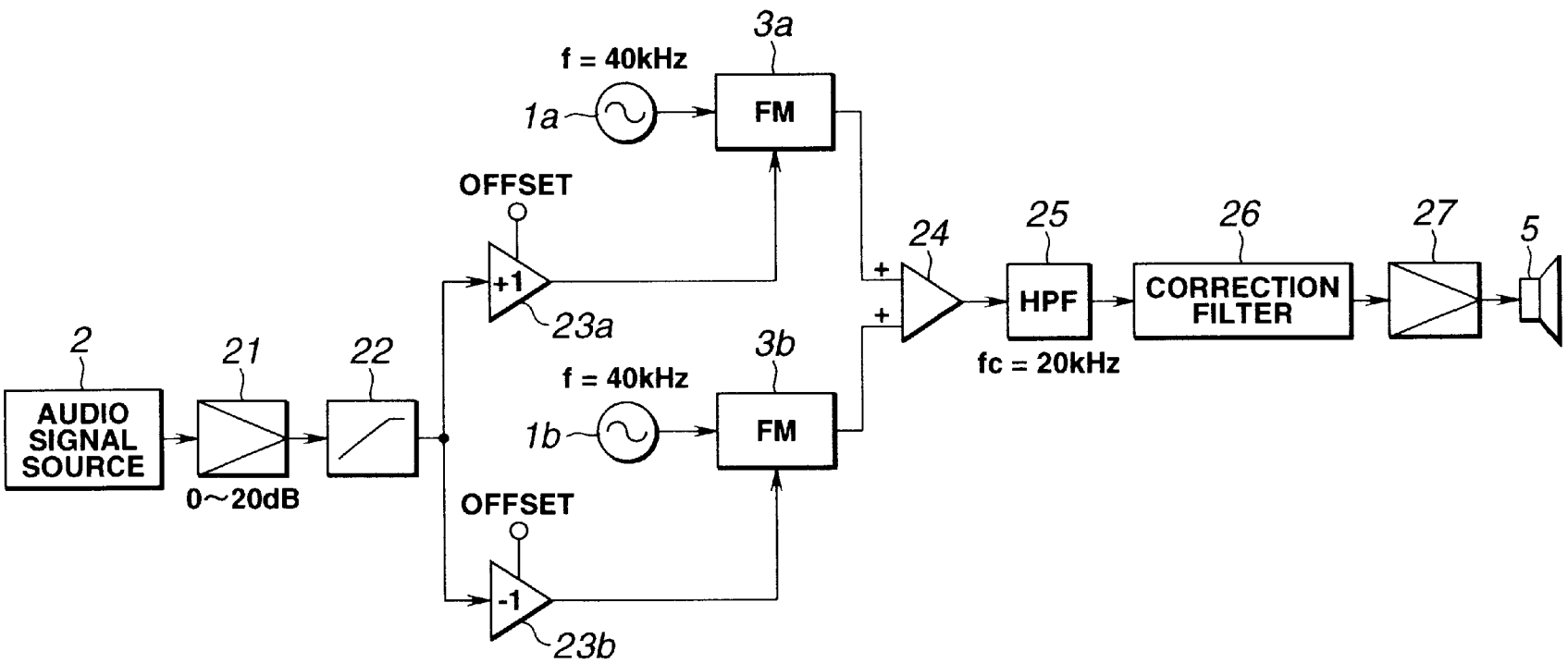
FIG. 6 is a schematic circuit diagram of another embodiment of a loudspeaker apparatus according to the invention.

The loudspeaker apparatus of FIG. 6 comprises first and second carrier wave oscillators 1*a*, 1*b* for generating respective carrier waves with respective predetermined frequencies, an audio signal source 2 for producing an audio signal, a differentiator 22 for differentiating the audio signal output from the audio signal source 2, an amplifier 23*a* for adding an offset voltage to the differentiated signal output from the differentiator 22, an inverting amplifier 23*b* for inverting the polarity of the differentiated signal output from the differentiator 22 and adding an offset voltage thereto, first and second frequency-modulators 3*a*, 3*b* for frequency-modulating the carrier waves from the first and second carrier wave oscillators 1*a*, 1*b* respectively by means of the differentiated signal from the amplifier 23*a* and the differentiated signal from the inverting amplifier 23*b*, a mixer for mixing the frequency-modulated signals output from the first and second frequency-modulators 3*a*, 3*b*, a correction filter 26 for suppressing predetermined frequency components of the mixed frequency-modulated signal from the mixer 24 and an ultrasonic generator 5 adapted to be driven by the frequency-modulated signal output from the correction filter 26.

The first and second carrier wave oscillators 1*a*, 1*b* supply carrier waves of, for example, 40 KHz respectively to the first and second frequency-modulators 3*a*, 3*b*. The audio signal source 2 supplies an audio signal to the differentiator 22 by way of an amplifier 21. The differentiator 22 differentiates the audio signal that has been amplified by the amplifier 21 and supplies the obtained differentiated signal to the amplifier 23*a* and the inverting amplifier 23*b*. The amplifier 23*a* adds an offset voltage to shift the DC level of the differentiated signal from the differentiator 22 and supplies the obtained signal to the first frequency-modulator 3*a* as a modulation signal. On the other hand, the inverting amplifier 23*b* inverts the polarity of the differentiated signal from the differentiator 22 and adds an offset voltage to shift the DC level so that it supplies the obtained signal to the second frequency-modulator 3*b* as a modulation signal. The first and second frequency-modulators 3*a*, 3*b* then frequency-modulate the carrier waves input from the first and second carrier wave oscillators 1*a*, 1*b* respectively by the modulation signals whose DC levels have been shifted by the amplifier 23 and the inverting amplifier 23*b* respectively. The obtained frequency-modulated signals are then input to the mixer 24, which mixer 24 mixes these two frequency-modulated signals and supplies the mixture to a high-pass filter 25 with a cut off frequency of, for example, 20 KHz. Thus, the high-pass filter 25 removes the frequency components under 20 KHz from the mixed signal output from the mixer 24 and supplies the obtained signal to the correction filter 26.

An ultrasonic generator 5 has mechanical resonance frequencies, for example, near 40 KHz and does not show a flat frequency characteristic. Therefore, the correction filter 26 is used to suppress predetermined frequency components near 40 KHz of the frequency-modulated signal from the high-pass filter 25 and supplies the signal obtained by suppressing the resonance frequency components to the ultrasonic generator 5 by way of an amplifier 27. The ultrasonic generator 5 comprises at least an ultrasonic generating device and is adapted to be driven by the frequency-modulated signal that has been amplified by the amplifier 27 to ultradirectionally emit an ultrasonic wave to the direction of the ultrasonic generator 5 according to the frequency-modulated signal.

Now, the principle underlying the operation of emitting sound of the above loudspeaker apparatus will be briefly described below.

Signal O(t) obtained by mixing two frequency-modulated signals is expressed by formula (4) below.

$$O(t)=A_c\cos(\omega_c t+\theta_c+k\int h(t)dt)+B_c\cos(\omega_c' t+\theta_c'+k'\int h(t)dt) \quad (4)$$

The distortion of degree 2 of the signal O(t) is expressed by formula (5) below.

$$\begin{aligned}O(t)^2=&Ac^2\cos^2(\omega_c t+\theta_c+k\int h(t)dt)+\\&Bc^2\cos^2(\omega_c' t+\theta_c'+k'\int h(t)dt)+\\&A_cB_c\cos((\omega_c+\omega_c')t+(\theta_c+\theta_c')+\\&(k+k')\int h(t)dt)+\\&A_cB_c\cos((\omega_c-\omega_c')t+(\theta_c-\theta_c')+\\&(k-k')\int h(t)dt)\end{aligned} \quad (5)$$

The first through third terms on the right side of the equation (5) represents the side waves centered around the DC, $2\omega_c$, $2\omega_c'$ and $(\omega_c+\omega_c')$, whereas the fourth term represents the side waves centered around $(\omega_c-\omega_c')$ that are found within an audible band and hence can be heard by man. Therefore, when the fourth term is equal to the original audio signal s(t) or when equation (6) below holds true, the audio signal s(t) can be audible by man.

$$A_cB_c\cos(\Delta\omega_c t+\Delta\theta_c+\Delta k\int h(t)dt)=s(t) \quad (6)$$

where $|s(t)|\leqq=1$, $\Delta\omega_c=\omega_c-\omega_c'$, $\Delta\theta_c=\theta_c-\theta_c'$ and $\Delta k=k-k'$. However, note that s(t) will be normalized by $A_cB_c$ to define s(t) anew hereinafter.

Formula (7) can be obtained by solving the equation (6) in terms of h(t).

$$h(t)=[d/dt\{\cos^{-1}s(t)\}-\Delta\omega_c]/\Delta k \quad (7)$$

Thus, the carrier wave is frequency-modulated by the signal h(t) as defined by equation (7). In other words, a sound corresponding to the original audio signal can be heard by subjecting the audio signal from the audio signal source 2 to an arithmetic operating using an inverse cosine function, adding a DC offset, differentiating the obtained signal and frequency-modulating the carrier wave by the differentiated signal.

Now, if s(t) is sufficiently small, $\cos^{-1}s(t)$ in the equation (7) can be approximated by $\pi/2-s(t)$ as a result of series development. Thus, signal h(t) can be expressed by formula (8) below.

$$h(t)\neq[d/dt\{-s(t)\}-\Delta\omega_c]/\Delta k \quad (8)$$

In the above described loudspeaker apparatus, a signal processing operation as expressed by the formula (8) is preformed by the differentiator 22, the amplifier 23*a* and the inverting amplifier 23*b*.

Now, another embodiment of loudspeaker apparatus according to the invention will be described by referring to FIG. 7.

Figure 7:
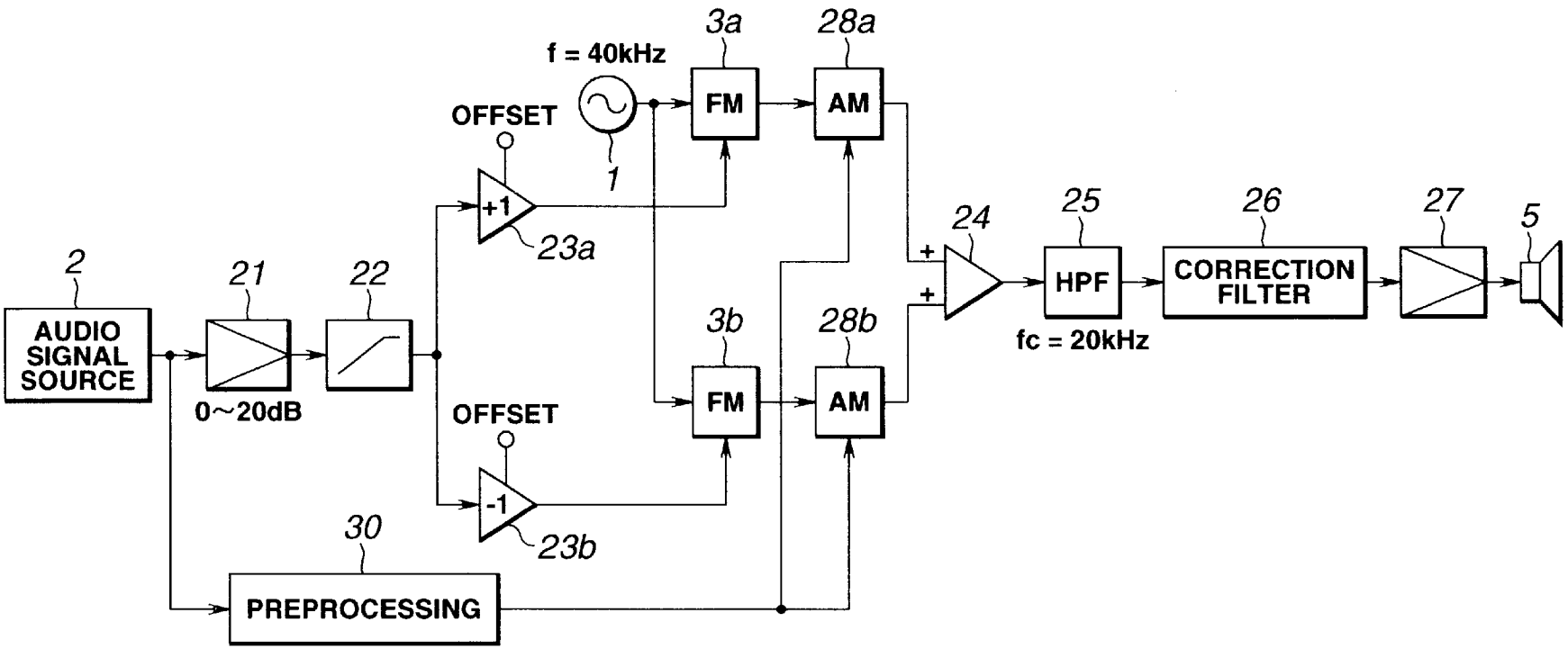
FIG. 7 is a schematic circuit diagram of still another embodiment of loudspeaker apparatus according to the invention.

As seen from FIG. 7, this embodiment of loudspeaker apparatus is realized by modifying that of FIG. 6 in such a way that the carrier wave oscillators 1*a*, 1*b* are replaced by a single carrier wave oscillator and amplitude-modulators 28*a*, 28*b* are added respectively downstream relative to the frequency-modulators 3*a*, 3*b* and a preprocessing circuit 30 is added upstream relative to them. Thus, the component circuits functionally the same as those of FIG. 6 are denoted respectively by the same reference numerals and will not be described here any further.

The added amplitude-modulators 28*a*, 28*b* respectively amplitude-modulate the frequency-modulated signals from the frequency-modulators 3*a*, 3*b* as carrier waves by using as a modulation signal the signal preprocessed by the preprocessing circuit 30 in a manner as described below and supply the obtained amplitude-modulated signals to the mixer 24.

Now, the principle underlying the operation of emitting sound of the above loudspeaker apparatus will be briefly described below.

The above described formula (4) can be modified to produce formula (9) below by using additional conditions of $A_c=B_c=A_c'/2$, $\Delta\omega_c=\omega_c-\omega_c'=0$, $\Delta\theta_c=\theta_c-\theta_c'$ and $k'=0$.

$$O(t)=[A_c'+A_c'\{-1+\cos((k/2)\int h(t)dt)\}]\times\cos(\omega_c t+\theta_c+(k/2)\int h(t)dt) \quad (9)$$

An amplitude-modulating operation using η(t) can be expressed by formula (10) below.

$$[y(t)]_{AM}=(A_c+\eta(t))\cos(\omega_c t+\theta_c) \quad (10)$$

The formula (10) above produces a signal the same as the one produced by the formula (9) when equation (11) below holds true.

$$\eta(t)=A_c'\{-1+\cos((k/2)\int h(t)dt)\}=A_c'\{-1+\cos((½)\cos^{-1}s(t))\} \quad (11)$$

Figure 9:
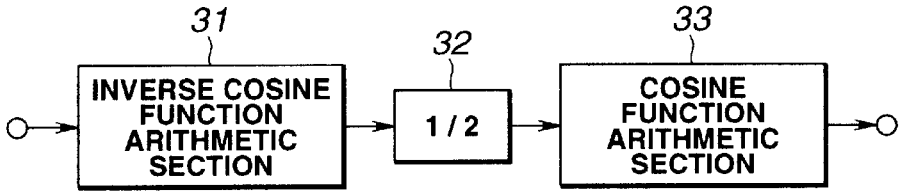
FIG. 9 is a schematic block diagram of a DSP that can be used for the preprocessing circuit of a loudspeaker apparatus according to the invention, illustrating its function.

In the above loudspeaker apparatus, the preprocessing circuit 30 typically comprises a digital signal processor (DSP) and a memory storing instructions and data for driving the DSP, which typically comprises an inverse cosine function operating section (arithmetic section) 31, a multiplier 32 for multiplying the output of the inverse cosine function operating section 31 by ½ and a cosine function operating section 32 for determining the cosine of the output of the multiplier 32 in order to carry out a signal processing corresponding to the formula (11), as shown in FIG. 9. In other words, the inverse cosine function operating section 31 performs an operation of processing the audio signal from the audio signal source 2 by means of an inverse cosine function and the multiplier 32 multiplies the obtained result by ½ and the cosine function operating section 33 determines the cosine of the output of the multiplier 32.

The second term on the right side of the formula (11) can be modified to formula (12) below.

$$\cos((½)\cos^{-1}s(t))=((1+s(t))/2)^{1/2} \quad (12)$$

Figure 10:
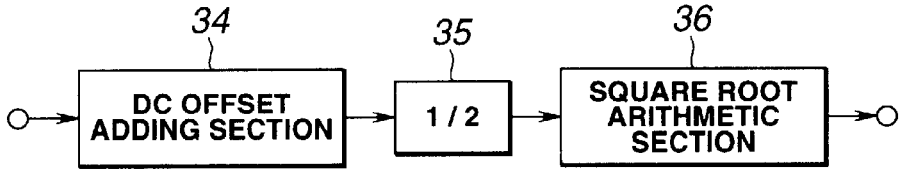
FIG. 10 is a schematic block diagram of another DSP that can be used for the preprocessing circuit of a loudspeaker apparatus according to the invention, illustrating its function.

Therefore, the preprocessing circuit 30 may comprise a DC offset adding section 34, a multiplier 35 for multiplying the output of the DC offset adding section 34 by ½ and a square root arithmetic section 36 for determining the square root of the output of the multiplier 35 as shown in FIG. 10. When the preprocessing circuit 30 is configured in the above described manner, the DSP has to perform only an arithmetic operation of determining a square root and is not required to perform arithmetic operations using a cosine function and an inverse cosine function so that the overall processing time and the memory capacity required to the loudspeaker apparatus can be significantly reduced. Thus, the circuit size can be significantly reduced if compared with a case where these arithmetic operations are carried out by means of hardware.

Figure 11:
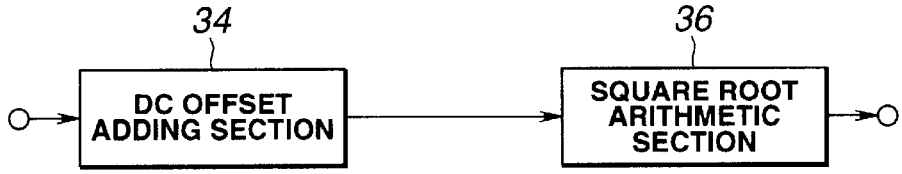
FIG. 11 is a schematic block diagram of still another DSP that can be used for the preprocessing circuit of a loudspeaker apparatus according to the invention, illustrating its function.

Additionally, since the arithmetic operation of multiplying the output by ½ can be omitted because its effect is only that of modifying the amplitude of the modulated output. Thus, the preprocessing circuit 30 can be made to comprise only a DC offset adding section 34 for adding a DC offset to an audio signal and a square root arithmetic section 36 for determining the square root of the output of the DC offset adding section 34, as shown in FIG. 11. When the preprocessing circuit 30 is configured so, the DSP is no longer required to perform arithmetic operations using a cosine function and an inverse cosine function and has to perform only an arithmetic operation of determining a square root so that the overall processing time and the memory capacity required to the loudspeaker apparatus can be significantly reduced. Thus, again the circuit size can be significantly reduced if compared with a case where these arithmetic operations are carried out by means of hardware.

In the above embodiment of loudspeaker apparatus, a carrier wave is frequency-modulated by means of an audio signal to produce a frequency-modulated signal that is used to drive the ultrasonic generator 5, which typically comprises a plurality of piezoelectric devices as described above. Therefore, a correction filter 26 may be arranged upstream relative to each of the piezoelectric devices to provide the ultrasonic generator with a desired frequency characteristic and a desired directivity as a whole. Additionally, the ultrasonic generator may be made to show a desired frequency characteristic and a desired directivity as a combined effect of itself and the amplifier 4 as shown in FIGS. 1 and 2 or the amplifier 27 as shown in FIGS. 6 and 7. Still additionally, it may be so arranged that a correcting operation is conducted on the audio signal so as to realize a desired frequency characteristic.

A pair of loudspeaker apparatus having a configuration as described above may be used and arranged in such a way that different audio signals are input to them and filters with different frequency characteristics and phase characteristics are placed upstream relative to the respective piezoelectric devices of the loudspeaker apparatus. Then, sounds may be emitted with different respective directives from a same position so that the listener may hear the sounds differently depending on the spot he or she is located.

Since a loudspeaker apparatus according to the invention shows a very high directivity, it can provide audio information to a specific location.

Therefore, an audio signal transmitting apparatus having a secret talk feature can be realized by using a loudspeaker apparatus according to the invention without using connection lines for signal transmission.

Figure 8:
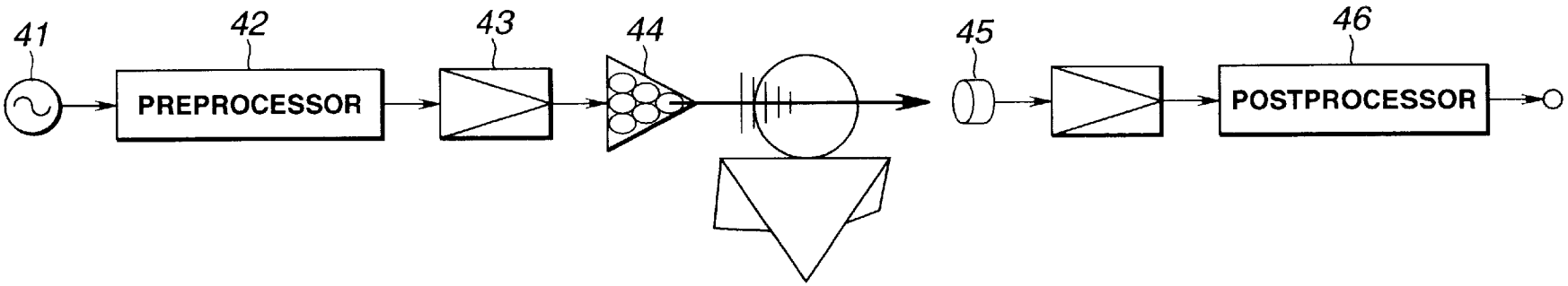
FIG. 8 is a schematic circuit diagram of an audio signal transmitting/receiving apparatus realized by using a loudspeaker apparatus according to the invention.

As shown in FIG. 8, such an audio signal transmitting apparatus may typically comprise an audio signal source 41 for generating an audio signal, a preprocessor 42 for frequency-modulating a carrier wave by means of a signal obtained by differentiating the audio signal, an ultrasonic generator 44 adapted to be driven by the frequency-modulated signal from the preprocessor 42, a microphone 45 for an audible band and a postprocessor 46 for processing the signal from the microphone 45 by means of an inverse cosine function.

The preprocessor 42 typically comprises an amplifier 21 and a correction filter 26 same as those used in the loudspeaker apparatus of FIG. 6 and is adapted to drive the ultrasonic generator 44 by way of an amplifier 43 by means of the frequency-modulated signal obtained by frequency-modulating a carrier wave by the audio signal from the audio signal source. Therefore, of the sound waves emitted from the ultrasonic generator 44, only the sound expressed by the fourth term on the right side of the above formula (5) or formula (13) below can be heard by man.

$$y(t)=\cos(\Delta\omega_c t+\Delta\theta_c+\Delta k\int h(t)dt) \tag{13}$$

The microphone 45 is designed to detect sounds in an audible band and outputs signal y(t) as expressed by the formula (13) above. The postprocessor 46 performs a signal processing operation corresponding to formula (14) below to restore the original audio signal h(t).

$$kh(t)=[d/dt\{\cos^{-1} y(t)\}-\Delta\omega_c] \tag{14}$$

Then, the user can hear a sound corresponding to the original audio signal by reproducing the signal output from the postprocessor 46 by means of a headphone set, for example. However, any third party located between the ultrasonic generator 44 and the microphone 45 cannot comprehend the sound because it is remarkably distorted there. Also, any other person of a third party located off the direction of the ultrasonic generator 44 cannot hear the sound. Thus, the audio signal emitted from the audio signal transmitting apparatus will not be picked up by any third party.

Now, an example of correcting operation to obtaining a desired frequency characteristic as described above will be discussed below.

In the case of a loudspeaker apparatus illustrated in FIG. 7, a signal is frequency-modulated by an audio signal and the obtained signal is amplitude-modulated by the output of the preprocessing circuit 30 so that, if a same extent of modulation is used, the output h(t) of the frequency-modulators 3*a*, 3*b* (hereinafter referred to simply as modulator output) can be expressed by formula (15) below whereas the output g(t) of the amplitude-modulators 28*a*, 28*b* can be expressed by formula (16) below.

$$h(t)=\cos((½)\cos^{-1} s(t)) \tag{15}$$

$$g(t)=h(t)\cos(\omega_c t+\theta) \tag{16}$$

If a same extent of modulation is used for the equation (15), the added modulation effect is made equal to 0 so that the terms relating to frequency-modulation are eliminated from the cosine function and hence the equation (16) relates only to amplitude-modulation as a whole.

If the Fourier transformation of signal h(t) output from the preprocessing circuit 30 is expressed by H(ω) as shown in formula (17) below, the modulated output g(t) of the formula (16) can be expressed by formula (18) by using H(ω).

$$H(\omega) = \int_{-\infty}^{\infty} h(t)e^{-j\omega t}dt \tag{17}$$

$$G(\omega)=(H(\omega+\omega_c)+H(\omega-\omega_c)) \tag{8}$$

Additionally, the square of the distortion $g_2(t)$ of signal g(t) and its Fourier transform are expressed by formulas (19) and (20) respectively.

$$g_2(t)=(g(t))^2 \tag{19}$$

$$\begin{aligned} G(\omega) &= \frac{1}{2\pi}\int_{-\infty}^{\infty} G(k)G(\omega-k) \\ &= \frac{1}{2\pi}\cdot\frac{1}{4}\int_{-\infty}^{\infty}\{H(k+\omega_c)H(\omega-k+\omega_c)+ \\ &\quad H(k-\omega_c)H(\omega-k-\omega_c)+H(k+\omega_c)H(\omega-k-\omega_c)+ \\ &\quad H(k-\omega_c)H(\omega-k+\omega_c)\}dk \end{aligned} \tag{20}$$

If H(ω) is limited for the band by angular frequency $\omega_s$ and spreads mainly only in an audio band whereas the central frequency of modulation shows an ultrasonic band more than twice of $\omega_s$ as expressed by formulas (21) and (22) below:

$$H(\omega)=0 \tag{21}$$

and $$\omega_c>2\omega_s \tag{22}$$

then, formula (23) holds true for the four terms on the right side of the equation (20).

$$H(\cdot)H(\cdot)\neq 0 \tag{23}$$

The conditions for making the formula (23) hold true are as listed below.

$$H(k+\omega_c)H(\omega-k+\omega_c)-2\omega_c-2\omega_s\leqq\omega\leqq-2\omega_c+2\omega_s$$

$$H(k-\omega_c)H(\omega-k-\omega_c)+2\omega_c-2\omega_s\leqq\omega\leqq+2\omega_c+2\omega_s$$

$$H(k+\omega_c)H(\omega-k-\omega_c)-2\omega_s\leqq\omega\leqq+2\omega_s$$

$$H(k-\omega_c)H(\omega-k+\omega_c)-2\omega_s\leqq\omega\leqq+2\omega_s$$

Since what is dealt here is the audio band components of the square of the distortion (difference frequency), the first two terms on the right side of the formula (20) expressing the components spreading in the ultrasonic wave band ($\pm 2\omega_c-2\omega_s\leqq\omega\leqq\pm 2\omega_c+2\omega_s$) can be neglected to save the last two terms expressing the components spreading in and near the audible band ($-2\omega_s\leqq\omega\leqq+2\omega_s$). Then, formula (24) below can be obtained.

$$\begin{aligned}
G_2(\omega) &= \frac{1}{2\pi}\cdot\frac{1}{4}\int_{-\infty}^{\infty}\{H(k+\omega_c)H(\omega-k-\omega_c)+ \\
&\quad H(k-\omega_c)H(\omega-k+\omega_c)\}dk \\
&= \frac{1}{2\pi}\cdot\frac{1}{4}\left\{\int_{-\infty}^{\infty}H(k+\omega_c)H(\omega-k-\omega_c)dk+\right. \\
&\quad \left.\int_{-\infty}^{\infty}H(k-\omega_c)H(\omega-k+\omega_c)dk\right\} \\
&= \frac{1}{2\pi}\cdot\frac{1}{4}\left\{\int_{-\omega_c+\omega_s}^{-\omega_c+\omega_s}H(k+\omega_c)H(\omega-k-\omega_c)dk+\right. \\
&\quad \left.\int_{\omega_c-\omega_s}^{\omega_c+\omega_s}H(k-\omega_c)H(\omega-k+\omega_c)dk\right\} \\
&= \frac{1}{2\pi}\cdot\frac{1}{4}\left\{\int_{-\omega_s}^{+\omega_s}H(k)H(\omega-k)dk+\right. \\
&\quad \left.\int_{-\omega_s}^{+\omega_s}H(k)H(\omega-k)dk\right\} \\
&= \frac{1}{2\pi}\cdot\frac{1}{2}\int_{-\omega_s}^{+\omega_s}H(k)H(\omega-k)dk
\end{aligned} \tag{24}$$

Ideally, the output g(t) of the amplitude-modulators 28*a*, 28*b* is emitted from the ultrasonic generator 5, maintaining its characteristics, and the difference frequency components of the square of the distortion generated in the air agree with the audio signal. However, a sound exactly corresponding to the signal g(t) would not be produced due to the characteristics of the ultrasonic generator 5 and the amplifier 27 arranged upstream relative to the ultrasonic generator. Note that the characteristic that changes the characteristic of the signal g(t) is expressed as loudspeaker characteristic a(t) hereinafter.

The loudspeaker output, or the output x(t) of the ultrasonic generator 5, is expressed by convoluting the signal g(t) and the loudspeaker characteristic a(t) as shown below.

$$x(t)=a(t)*g(t) \tag{25}$$

$$X(\omega)=A(\omega)G(\omega) \tag{26}$$

Note that * in the formula (25) represents an operation of convolution.

Figure 12:
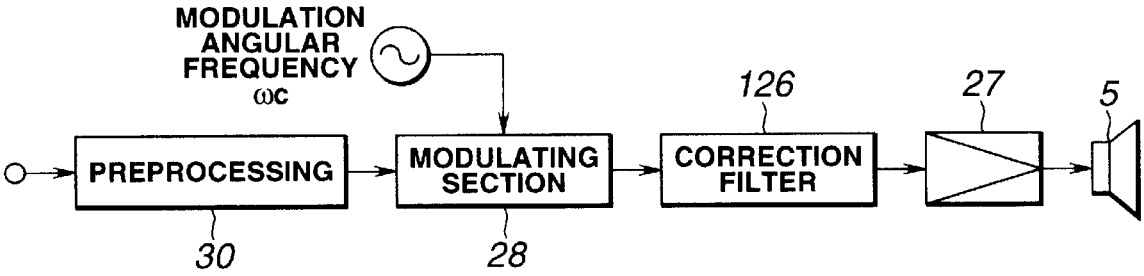
FIG. 12 is a schematic block diagram of a loudspeaker apparatus according to the invention and comprising a correction filter, showing a possible circuit configuration thereof.

In the formula (26) for the loudspeaker output $X(\omega)$, the influence of the loudspeaker characteristic a(t) can be eliminated by additionally arranging a filter having a characteristic inverse relative to the loudspeaker characteristic a(t) at least in the band where the modulator output $G(\omega)$ spreads at a position upstream relative to the loudspeaker. More specifically, a correction filter 126 having a characteristic inverse relative to the characteristic of the ultrasonic generator 5 is arranged at the output of the amplitude-modulator 28 as shown in FIG. 12 and a signal expressed by formula (27) below is input to the ultrasonic generator 5.

$$G_a(\omega)=A^{-1}(\omega)G(\omega) \tag{27}$$

Now, an example of correcting operation to be conducted on the audio signal to obtain a desired frequency characteristic will be discussed below.

The component of the square of the distortion $x_2(t)$ in an audio band can be determined by formula (29) shown below that is obtained by using conditions including $|\omega|\leqq 2\omega_s$ as in the case of the development of $G_2(\omega)$ shown by the formula (20).

$$x_2(t) = (x_2(t))^2 \tag{28}$$

$$\begin{aligned}
X_2(\omega) &= \frac{1}{2\pi}\int_{-\infty}^{\infty}X(k)X(\omega-k)dk \\
&= \frac{1}{2\pi}\int_{-\infty}^{\infty}A(k)A(\omega-k)\cdot G(k)G(\omega-k)dk \\
&= \frac{1}{2\pi}\cdot\frac{1}{4}\int_{-\infty}^{\infty}\{A(k)A(\omega-k)\}\cdot \\
&\quad \{H(k+\omega_c)H(\omega-k-\omega_c)+ \\
&\quad H(k-\omega_c)H(\omega-k+\omega_c)\}dk \\
&= \frac{1}{2\pi}\cdot\frac{1}{4}\int_{-\omega_s}^{\omega_s}\{A(k-\omega_c)A(\omega-k+\omega_c)+ \\
&\quad A(k+\omega_c)A(\omega-k-\omega_c)\}\cdot H(k+\omega_c)H(\omega-k)dk
\end{aligned} \tag{29}$$

The development of the equation (28) can be summarized as "the effect of modulation centered at $\omega_c$ and carried out by signal H(k) that is moved into the formula of the loudspeaker characteristic A(k)". $A(k-\omega_c)$ and $A(k+\omega_c)$ for the loudspeaker characteristic in the formula (29) corresponds to a loudspeaker characteristic having an effect of modulation.

The loudspeaker characteristic shows a power characteristic that is not flat and has peaks at $\pm\omega_c$ as shown in FIG. 14(C) which show different curves on the opposite sides thereof. While the characteristic of FIG. 14(C) is a simplified copy of the characteristic of a popular ultrasonic piezoelectric device, it shows approximately linear slopes if the power is expressed in terms of dB.

Such an asymmetric loudspeaker characteristic should be corrected simultaneously in two aspects as shown in FIG. 14(D) if corrected in an audio band typically at the output of the preprocessing circuit 30 as shown in FIG. 13. For instance, such a correcting operation can be carried out by selecting a piezoelectric device showing symmetric power curves at the opposite sides of the modulated frequency (the frequency of the carrier wave) or by correcting the symmetry of the power curves after modulating the frequency.

An operation of correcting the symmetry at the stage of modulating the frequency or a subsequent stage corresponds to satisfying the requirement of formula (30) below. Then, equation (31) there below holds true.

$$A(k-\omega_c)=A(k+\omega_c) \tag{30}$$

$$A(k-\omega_c)A(\omega-k+\omega_c)+A(k+\omega_c)A(\omega-k-\omega_c)=2A(k+\omega_c)A(\omega-k+\omega_c) \tag{31}$$

Then, the formula (29) above expressing the square of a distortion can be modified to obtain formula (32) below so that the loudspeaker characteristic A(k) can be processed together with input signal H(k) of the amplitude-modulator 28.

$$\begin{aligned} X_2(\omega) &= \frac{1}{2\pi}\cdot\frac{1}{4}\int_{-\omega_s}^{\omega_s} 2A(k+\omega_c)A(\omega-k+\omega_c)\cdot \\ &\quad H(k)H(\omega-k)dk \\ &= \frac{1}{2\pi}\cdot\frac{1}{4}\int_{-\omega_s}^{\omega_s} 2A(k+\omega_c)H(k)\cdot A(\omega-k+\omega_c)\cdot \\ &\quad H(\omega-k)dk \end{aligned} \tag{32}$$

Therefore, the inverse characteristic $A^{-1}(k+\omega_c)$ in the band of $|k|\leqq\omega_s$ of the transformed loudspeaker characteristic $A(k+\omega_c)$ so as to spread over an audio band is multiplied by $H(\omega)$ to obtain a new input $H_a(\omega)$ of the amplitude-modulator 28. More specifically, a correction filter 226 with the above described inverse characteristic of $A^{-1}(k+\omega_c)$ is arranged between the preprocessing circuit 30 and the amplitude-modulator 28 as shown in FIG. 13.

Now, a number of applications of a loudspeaker according to the invention will be described below.

Figure 15:
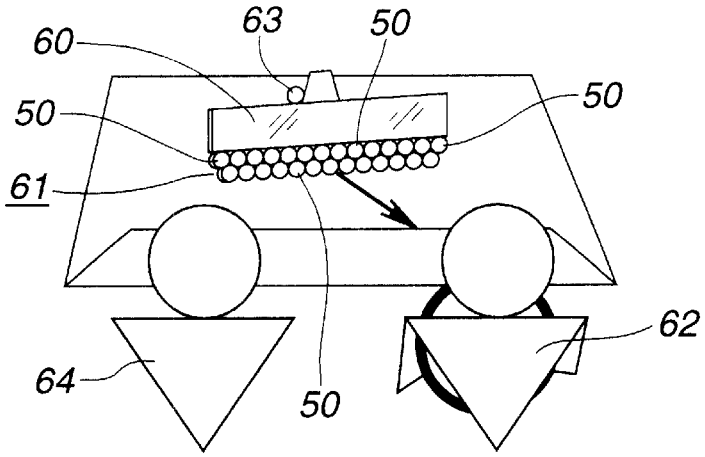
FIG. 15 is a schematic perspective view of a speech input/output apparatus of a hands-free type communication system comprising a loudspeaker apparatus according to the invention that is fitted to a room mirror of the inside of an automobile.

FIG. 15 is a schematic perspective view of the ultrasonic generator 61 of a loudspeaker according to the invention realized by combining a plurality of piezoelectric devices 50 and fitted to a rearview mirror 60 inside an automobile.

Since a rearview mirror 60 of an automobile is generally directed to the driver 62, the ultrasonic generator 61 will also be directed to the driver 62 so that the ultrasonic wave emitted from the ultrasonic generator 61 is made to concentratedly hit the driver 62 and hence only the driver 62 can hear the sound being carried by the ultrasonic wave. Thus, the loudspeaker apparatus brings audio information necessary only to the driver 62 without being heard by any other passengers of the automobile.

Additionally, since the ultrasonic wave emitted from the ultrasonic generator 61 is highly directional, a speech input/output apparatus of a hands-free type communication system can be realized by arranging a microphone 63 somewhere on the rearview mirror 60. Since the ultrasonic wave emitted from the ultrasonic generator 61 is highly directional as pointed out above, the ultrasonic wave emitted from the ultrasonic generator 61 would not be picked up by the microphone 63 to give rise to a phenomenon of howling if the microphone 63 is arranged near the ultrasonic generator 61. Still additionally, the ultrasonic wave emitted from the ultrasonic generator 61 is made to concentratedly hit the driver 62, the audio information carried by the ultrasonic wave is prevented from being picked up by any passenger 64 of the automobile to keep the secrecy of the audio information at least at the receiving side.

The piezoelectric devices 50 of the ultrasonic generator 61 may be divided into a plurality of groups and a filter may be arranged upstream relative to each of the groups of piezoelectric devices 50 to differentiate the frequency characteristic and the phase characteristic of the groups of piezoelectric devices 50. Then, the wave fronts of the ultrasonic waves emitted from the groups of piezoelectric devices 50 can be made to agree with respective specific directions so that the driver 62 and the passengers 64 may respectively enjoy different sounds or music.

Figure 16:
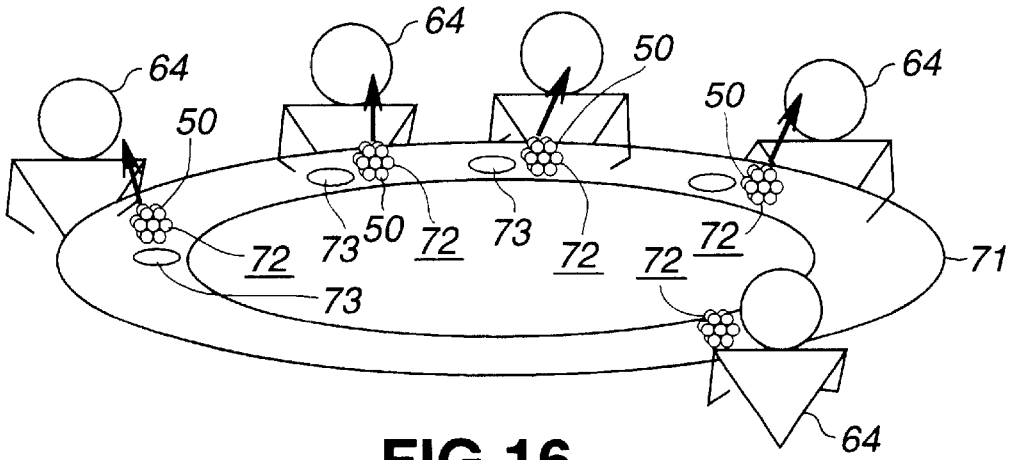
FIG. 16 is a schematic illustration of a conference system realized by using a loudspeaker apparatus according to the invention.

FIG. 16 is a schematic illustration of a conference system realized by using a loudspeaker apparatus according to the invention. The illustrated conference system comprises a plurality of sets of combinations of an ultrasonic generator 72 having a plurality of piezoelectric devices 50 and a microphone 73 arranged on a round table 71. As a plurality of ultrasonic generators 72 are arranged, the speeches emitted from the ultrasonic generators 72 as audio information can be made to concentratedly hit the respective attendees 74. If the attendees want to hear respective mother languages, they can be provided with language services spoken in their respective mother languages.

Figure 17:
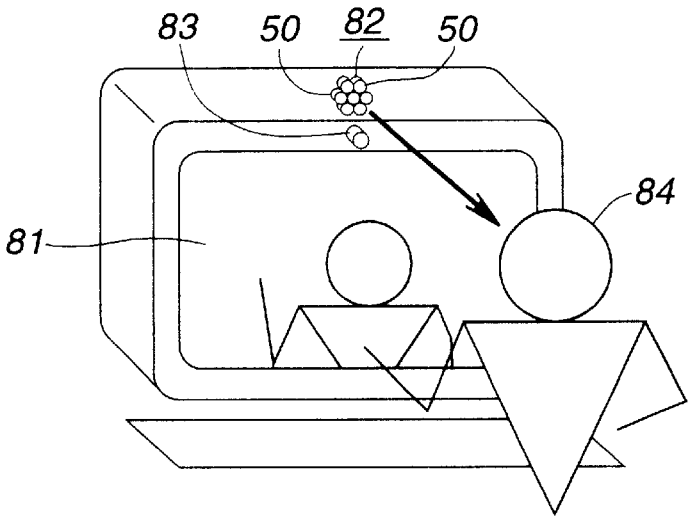
FIG. 17 is a schematic perspective view of a video telephone set comprising a loudspeaker apparatus according to the invention.

FIG. 17 is a perspective view of a video telephone set realized by applying a loudspeaker apparatus according to the invention. The illustrated video telephone set comprises an ultrasonic generator 82 having a plurality of piezoelectric devices 50 and a microphone 83 arranged on a video receiving unit 81. Since the ultrasonic wave emitted from the ultrasonic generator 82 is highly directional as pointed out above, the ultrasonic wave emitted from the ultrasonic generator 82 would not be picked up by the microphone 83 to give rise to a phenomenon of howling if the microphone 83 is arranged near the ultrasonic generator 82 so that a hands-free speech input/output system can be formed by them.

Figure 18:
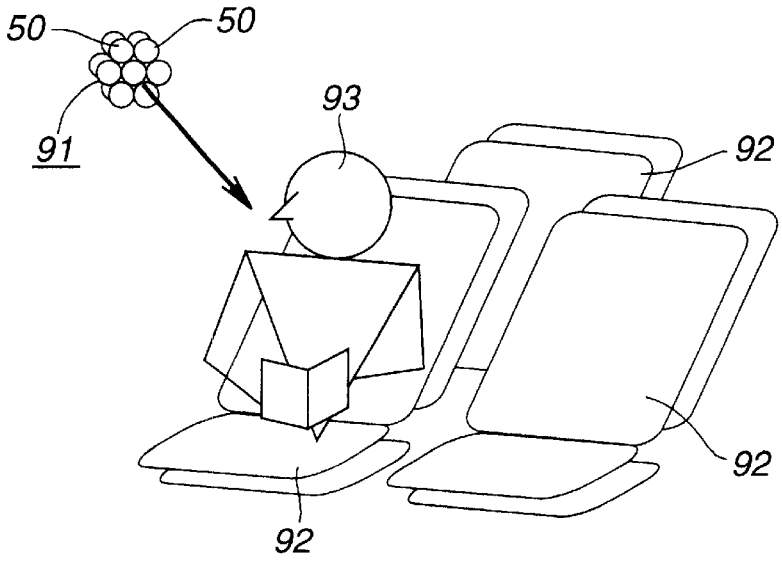
FIG. 18 is a schematic illustration of an acoustic system installed in a vehicle and comprising a loudspeaker apparatus according to the invention.

FIG. 18 is a schematic illustration of an acoustic system installed in a vehicle and comprising a loudspeaker apparatus according to the invention. The vehicle may be a bus, an aircraft or any other transportation means that can carry a large number of passengers at a time. Each of the ultrasonic generators 91 of the acoustic system comprises a plurality of piezoelectric devices 50 and arranged to the passenger/listener 93 sitting on a corresponding seat 92. This arrangement of ultrasonic generators 91 eliminates the use of headphones for the purpose of speech secrecy in providing desired audio information to each of the passengers/listeners 93.

Figure 19:
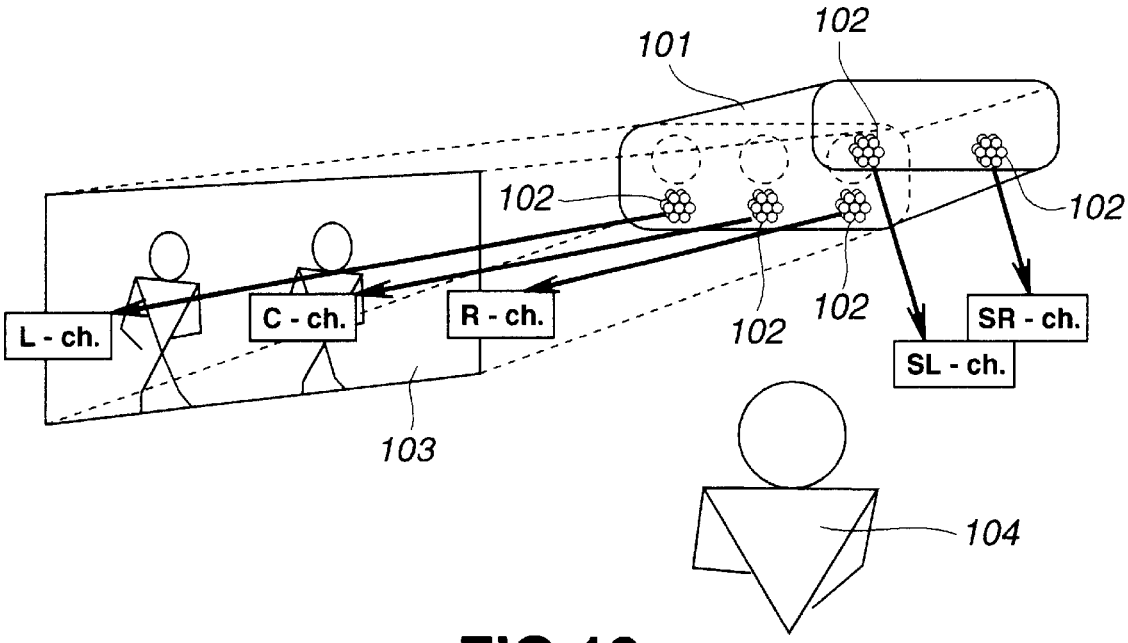
FIG. 19 is a schematic illustration of a video projector comprising loudspeaker apparatus according to the invention.

FIG. 19 is a schematic illustration of a video projector comprising loudspeaker apparatus according to the invention. The video projector comprises a plurality of ultrasonic generators 102, each having a plurality of piezoelectric devices 50, arranged in the projector main body 101. Each of the ultrasonic generators 102 arranged in the projector main body 101 is directed to the screen 103 onto which images are projected from the video projector or to a wall surface. As an ultrasonic wave is emitted from each of the ultrasonic generators 102 toward the screen 103 or a wall surface, a sound image is formed at the location where the ultrasonic wave emitted from the ultrasonic generator 102 is reflected.

Thus, the ultrasonic generators 102 may be used for a multi-channel sound source, including one for a right channel, one for a left channel, one for a central channel, one for a surround right channel, one for a surround left channel and so on depending on the audio signal produced from the multi-channel sound source so that the viewers/listeners 104 can enjoy multi-channel sounds.

Figure 20:
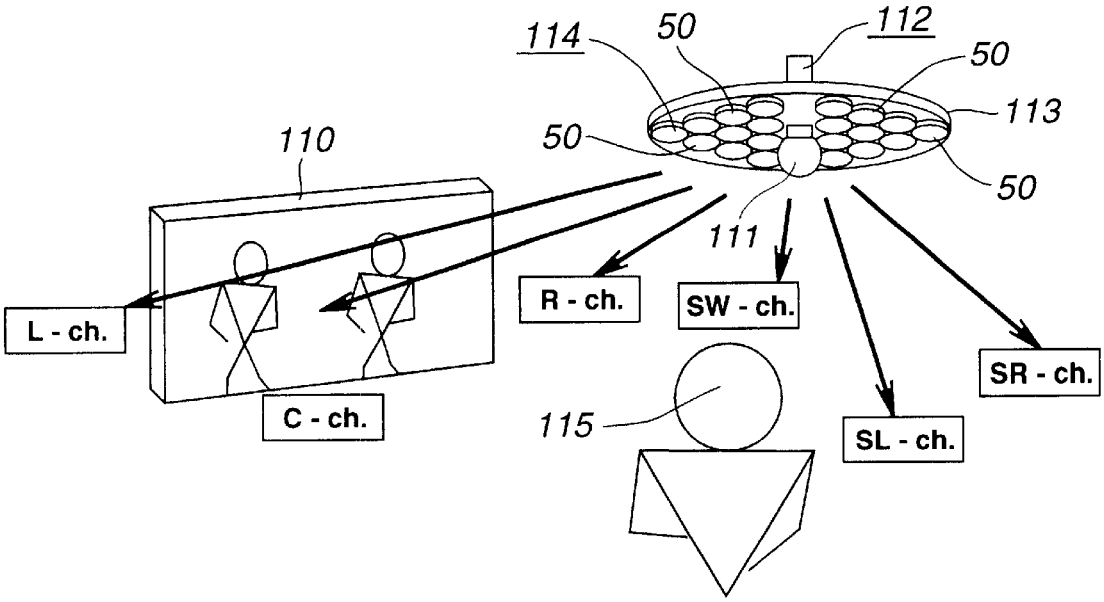
FIG. 20 is a schematic illustration of an audio-video system comprising loudspeaker apparatus according to the invention.

FIG. 20 is a schematic illustration of an audio-video system comprising a loudspeaker apparatus according to the invention and a flat-type image-display apparatus 110 using a liquid crystal display or a plasma display. The ultrasonic generator 114 of the loudspeaker apparatus of the audio-video system is realized by combining a plurality of piezoelectric devices 50 and fitted to a reflector panel 113 of a lighting unit suspended from the ceiling and comprising a lamp 111. The piezoelectric devices 50 of the ultrasonic generator 114 are fitted to the reflector panel 113 and directed to respective predetermined directions. The piezoelectric devices 50 of the ultrasonic generator 114 are divided into a plurality of groups and a filter is arranged upstream relative to each of the groups of piezoelectric devices 50 so that the groups of piezoelectric devices 50 show respective frequency characteristics and phase characteristics that are different from each other so that the groups of piezoelectric devices 50 are acoustically directed to respective directions other than the front.

As the ultrasonic waves emitted from the piezoelectric devices 50 are directed differently, the ultrasonic generator 114 comprising a plurality of piezoelectric devices 50 can emit ultrasonic waves for a multi-channel audio signal produced from a multi-channel sound source, including one for a right channel, one for a left channel, one for a central channel, one for a surround right channel, one for a surround left channel and so on depending on the audio signal produced from the multi-channel sound source so that the viewers/listeners 115 can enjoy multi-channel sounds.

Figure 21:
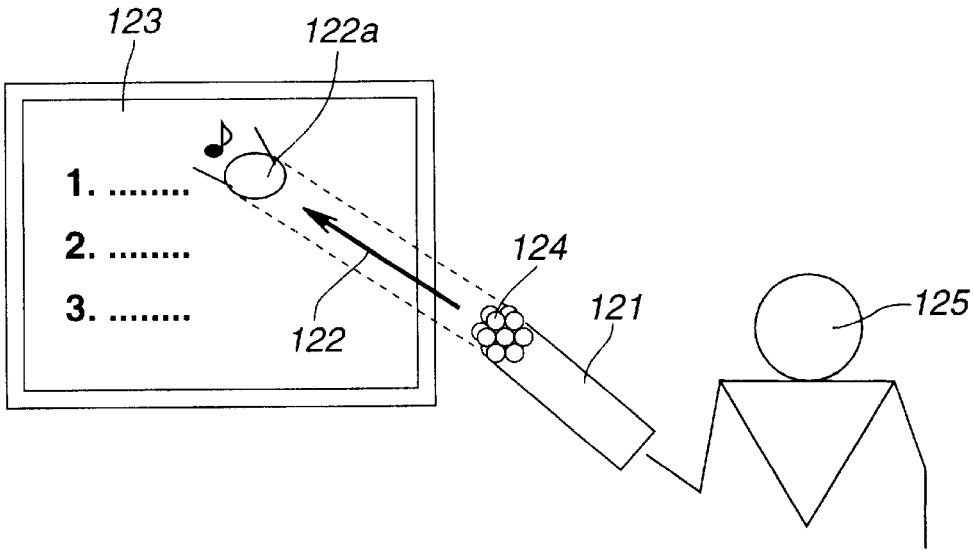
FIG. 21 is a schematic illustration of an index baton of an overhead projector system incorporating a loudspeaker apparatus according to the invention.

FIG. 21 is a schematic illustration of an indexing baton of an overhead projector system to which a loudspeaker apparatus according to the invention is applied. The index baton 121 is adapted to emit a laser beam 122 to illuminate and identify a desired spot on a display panel 123 and an ultrasonic generator 124 comprising a plurality of piezoelectric devices 50 is arranged on the laser beam emitting surface of the index baton 121. As an ultrasonic generator 124 is incorporated into the index baton 121, the speaker 125 using the baton can emit an ultrasonic wave and have it reflected from the spot 122*a* illuminated by a laser beam emitted from the index baton to form a sound image at the illuminated spot 122*a* so that the speaker can provide information effectively and impressively as a combined effect of a laser beam and a sound.

Figure 22:
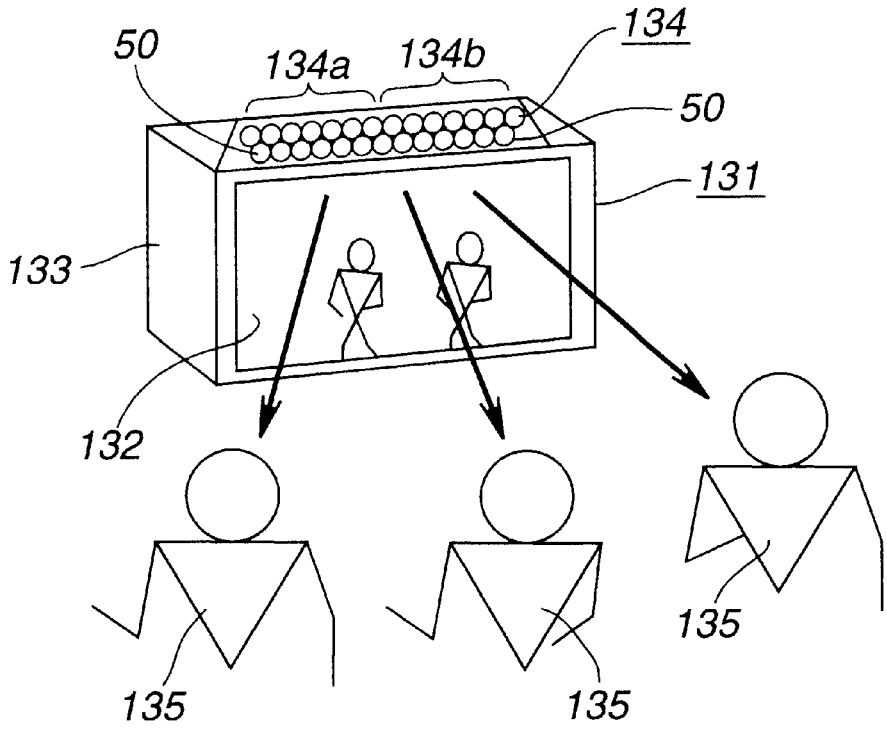
FIG. 22 is a schematic illustration of an information reproducing apparatus comprising a loudspeaker apparatus according to the invention and adapted to reproduce multilingual information from a recording medium.

FIG. 22 is a schematic illustration of an information reproducing apparatus 131 comprising loudspeaker apparatus according to the invention and adapted to reproduce information from an information recording medium carrying multi-lingual information recorded thereon. The reproducing apparatus 131 is provided with a pair of ultrasonic generators 134*a*, 134*b* comprising a plurality of piezoelectric devices 50 arranged along the upper edges of the apparatus main body 133 comprising a video receiving unit 132. Thus, the piezoelectric devices 50 are divided into two groups belonging to the respective ultrasonic generators 134*a*, 134*b*, which are driven by respective signals modulated by respective audio signals that may, for instance, correspond to different languages so that a plurality of viewers/listeners 135 can listen to different languages transmitted from the respective ultrasonic generators.

Figure 23:
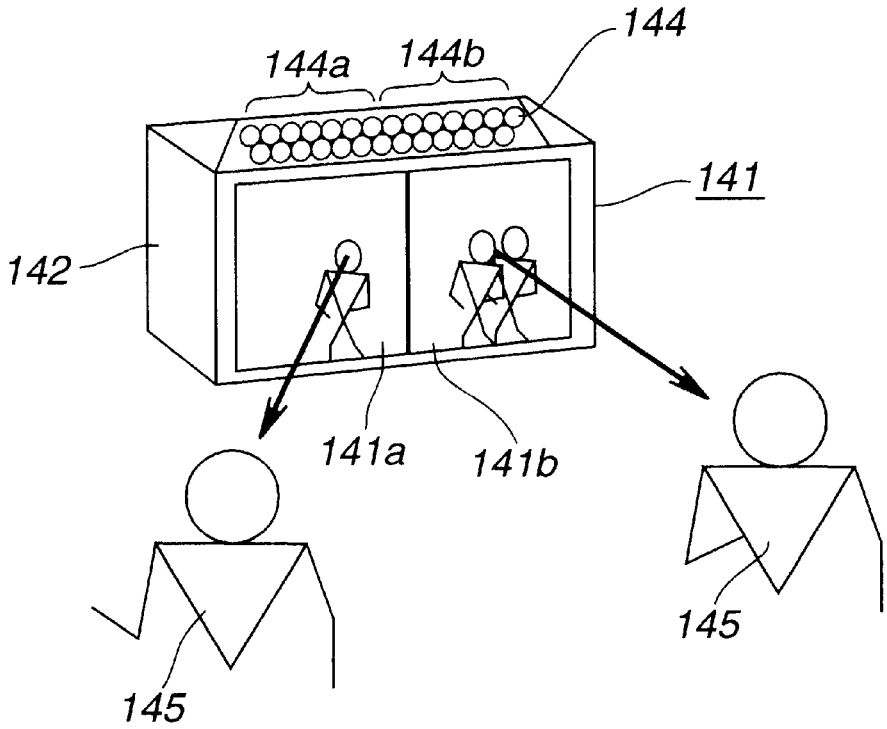
FIG. 23 is a schematic perspective view of a split-screen television receiving set comprising a loudspeaker apparatus according to the invention.

FIG. 23 is a schematic perspective view of a split-screen television receiving set comprising loudspeaker apparatus according to the invention. This television receiving set 141 comprises two groups of ultrasonic generators 144*a*, 144*b* realized by arranging a plurality of piezoelectric devices 50 along the upper edges of the television receiving set main body 142 for the respective screens 141*a*, 141*b*. Thus, the ultrasonic generators 144*a*, 144*b* are driven by respective signals modulated by respective audio signals that correspond to the respective screens 141*a*, 141*b* so that a plurality of viewers/listeners 145 can listen to different sounds corresponding to the respective screens 141*a*, 141*b* without being affected by the other sound.

Figure 24:
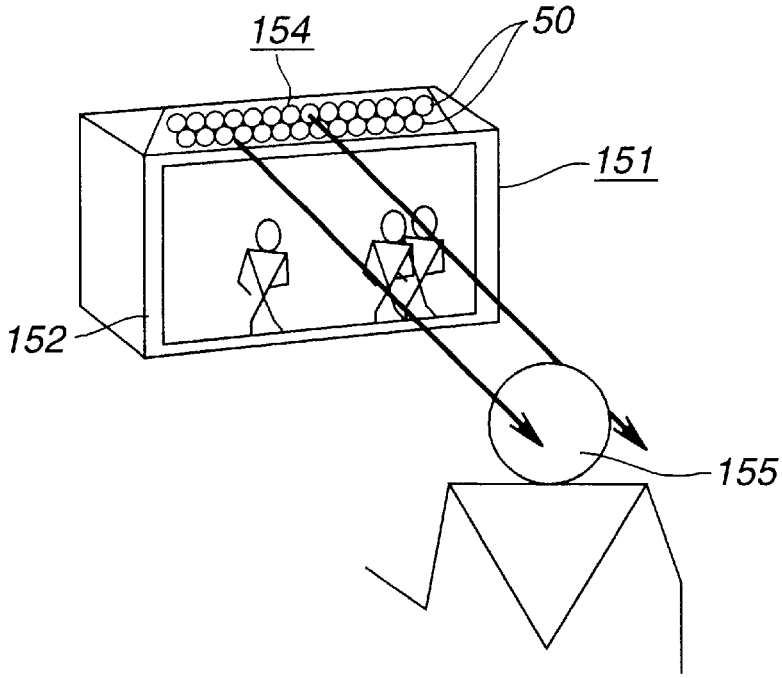
FIG. 24 is a schematic perspective view of a television receiving set comprising a loudspeaker apparatus according to the invention.

FIG. 24 is a schematic perspective view of a television receiving set 151 to which a loudspeaker apparatus according to the invention is applied. The television receiving set 151 comprises an ultrasonic generator 154 realized by arranging a plurality of piezoelectric devices 50 along the upper edges of the television receiving set main body 152. The piezoelectric devices 50 of the ultrasonic generator 154 are divided into two groups that are directed respectively to the right and left ears of viewer/listener 155. Thus, the piezoelectric devices are driven by respective signals obtained by frequency-modulating audio signals that have been binaurally recorded so that the viewer/listener 155 can listen to stereophonic sound without using a headphone.

It will be appreciated that, in the case of the information reproducing apparatus 131 and the television receiving set 141 illustrated respectively in FIGS. 22 and 23, the piezoelectric devices 50 may be directed respectively to the right and left ears of viewer/listener 155. Then, the piezoelectric devices 50 are driven by respective signals obtained by frequency-modulating respective audio signals that have been binaurally recorded so that the viewer/listener 155 can listen to stereophonic sound without using a headphone.

Figure 25:
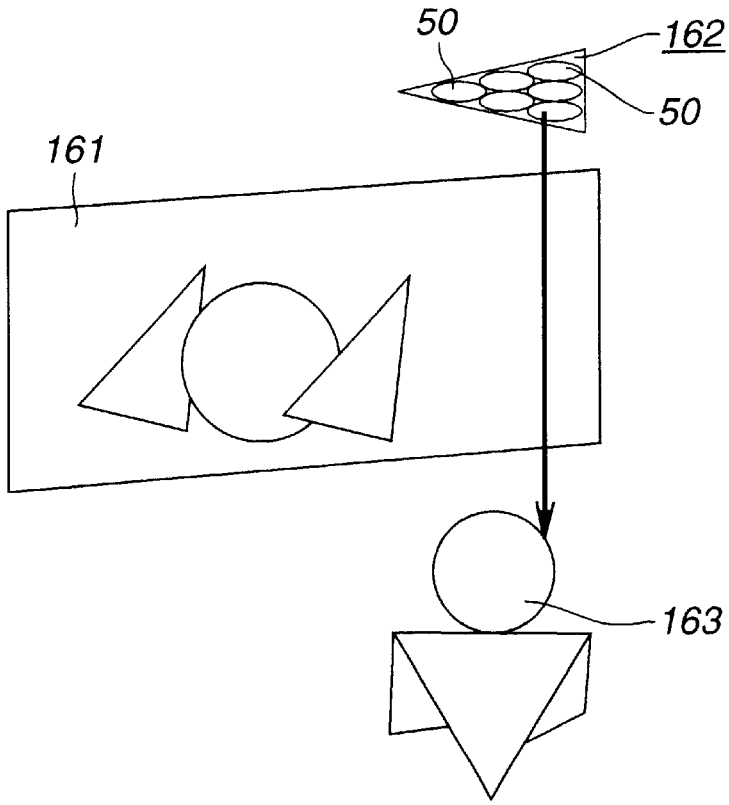
FIG. 25 is a schematic view of an illustration system comprising a loudspeaker apparatus according to the invention and designed to be used in a museum.

FIG. 25 is a schematic view of an illustration system comprising a loudspeaker apparatus according to the invention and designed to be used in an exhibition room of a museum. In FIG. 25, an ultrasonic generator 162 realized by combining a plurality of piezoelectric devices 50 is arranged under the ceiling of the exhibition room at a position above an exhibit 161. The ultrasonic generator 162 is directed to a position in front of the exhibit 161 so that only the visitor 163 viewing the exhibit 161 below the ultrasonic generator 162 can listen to the sound being emitted from the ultrasonic generator 162 so that the inside of the exhibition room is held in a quiet and good acoustic condition.

Figure 26:
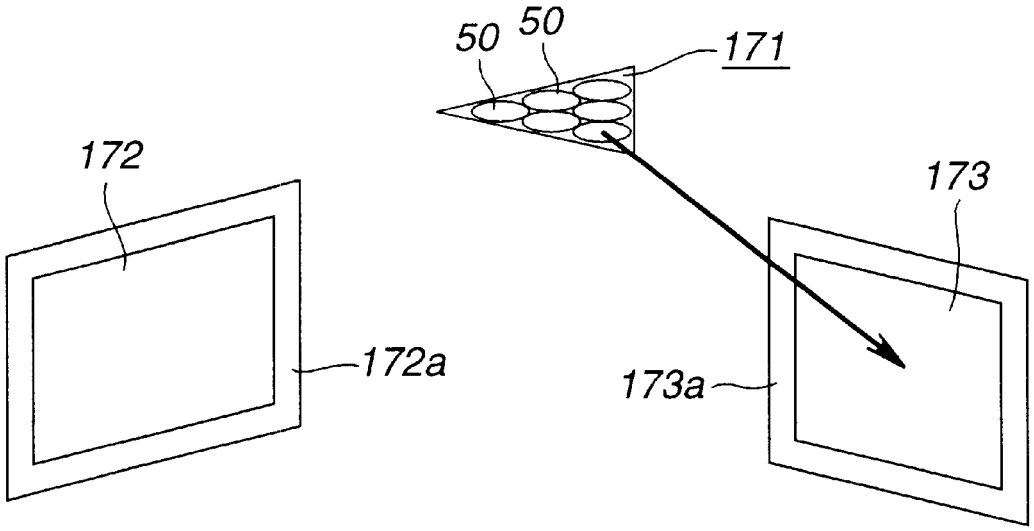
FIG. 26 is a schematic illustrative view of another illustration system comprising a loudspeaker apparatus according to the invention and designed to be used in a museum.

The loudspeaker apparatus of FIG. 26 comprises an ultrasonic generator 171 realized by combining a plurality of piezoelectric devices 50 and a pair of oscillation panels 172, 173 separated from the ultrasonic generator 171. The ultrasonic wave emitted from the ultrasonic generator 171 is directed to and reflected by the oscillation panels 172, 173 to reproduce sound in an audible band. The oscillation panels 172, 173 are realized by applying film to the surface of respective frame members 172*a*, 172*b* in such a way that the film is held under tension to a predetermined extent.

With such an arrangement, it is not necessary to provide each of the oscillation panels 172, 173 with a power source and a driver so that they may be arranged at any desired locations.

The oscillation panels 172, 173 may be used as interior decorations if designed appropriately.

Figure 27:
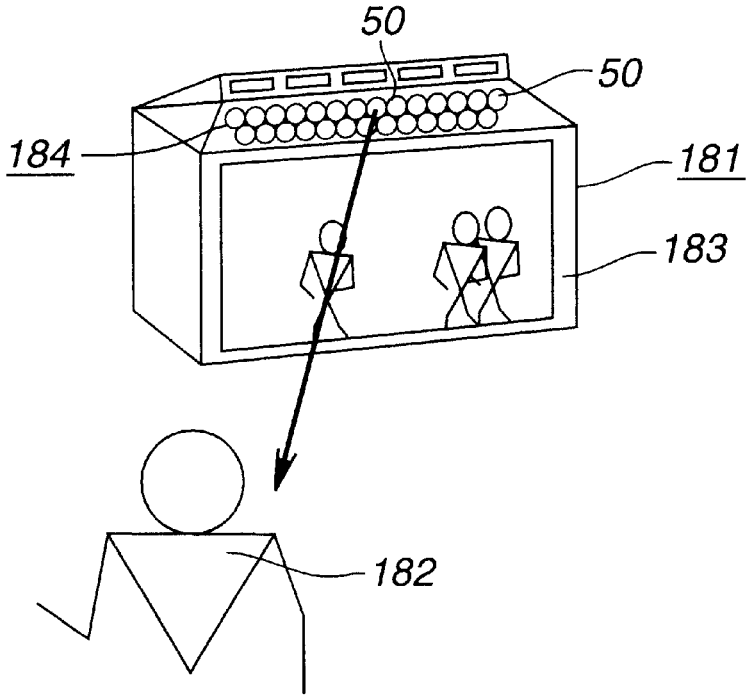
FIG. 27 is a schematic perspective view of a television receiving set comprising a loudspeaker apparatus according to the invention and having a tracking feature.

FIG. 27 is a schematic perspective view of a television receiving set 181 comprising a loudspeaker apparatus according to the invention and having a tracking feature. The loudspeaker apparatus can track the viewer/listener 182 and variably direct itself to the spot where the viewer 182 is located. The ultrasonic generator 184 of the loudspeaker apparatus is realized by arranging a plurality of piezoelectric devices 50 along the upper front edge of the television receiving set main body 183 of the television receiving set 181 and a location detecting means 185 for detecting the location of the viewer/listener 182 is arranged along the upper edge of the ultrasonic generator 184. The ultrasonic generator 184 variably directs itself to the location of the viewer/listener 182 for the emission of an ultrasonic wave according to the detection output of the location detecting means 185. Note that the plurality of piezoelectric devices 50 are arranged in two rows along the upper front edge of the television receiving set main body 183.

Figure 28:
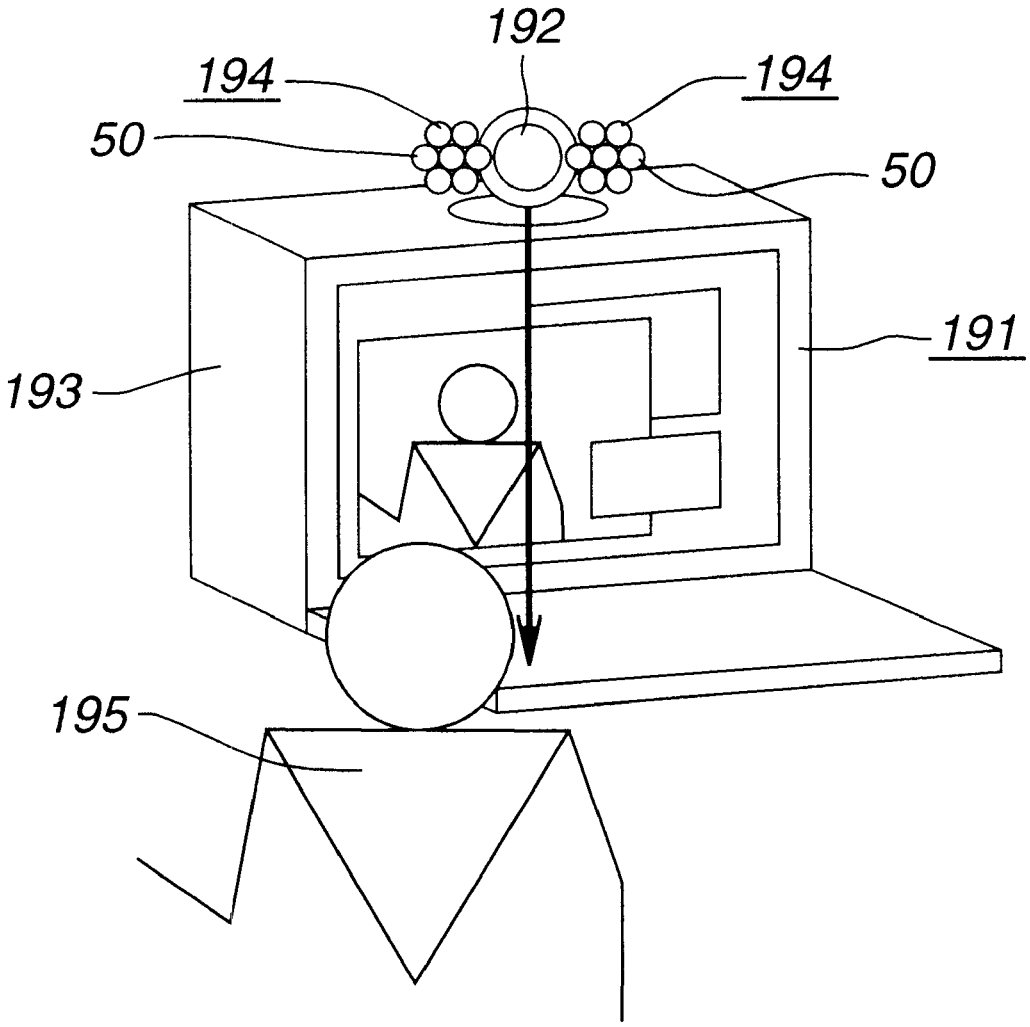
FIG. 28 is a schematic perspective view of another television receiving set comprising a loudspeaker apparatus according to the invention and also having a tracking feature.

FIG. 28 is a schematic perspective view of another television receiving set 191 comprising a loudspeaker apparatus according to the invention and also having a tracking feature. An imaging/tracking mechanism 192 is arranged on top of the television receiving set main body 193 and provided with means for driving itself to rotate and means for recognizing a specific object by image processing so that it can track the object if the latter moves. The imaging/tracking mechanism 192 comprises as integral part thereof an ultrasonic generator 194 realized by arranging a plurality of piezoelectric devices 50.

Note that the plurality of piezoelectric devices 50 of the ultrasonic generator 194 are divided into two groups, which are arranged respectively at the opposite lateral sides of the imaging/tracking mechanism 192.

By arranging an ultrasonic generator 194 that can integrally rotate or move with an imaging/tracking mechanism adapted to track a specific object, audio information is provided always only to the viewer/listener 195.

As described above in detail, a loudspeaker apparatus according to the invention is designed to frequency-modulate an audio signal output from a sound source into a signal showing a frequency band at least higher than the audible band by means of a modulating means and drive one or more than one ultrasonic generating devices by the frequency-modulated signal from the modulating means so as to cause an ultrasonic wave to be emitted therefrom and reflected in space or by an oscillating surface to produce audible sound with a very high directivity so that a sound image may be formed at any desired spot.

Since an audio signal transmitting/receiving apparatus comprising such a loudspeaker apparatus shows a very high directivity, it can transmit and receive audio signals with an enhanced level of talk secrecy.

What is claimed is:

1. A loudspeaker apparatus comprising:

first modulating means for frequency-modulating an audio signal and producing a first output signal of a frequency band higher than an audible frequency band;

second modulating means including an inverter for frequency modulating said audio signal and producing an inverted second signal of a frequency band higher than the audible frequency band; and ultrasonic generating means driven by the first output signal of said first modulating means and by the second output signal of said second modulating means for emitting ultrasonic waves.

2. The loudspeaker apparatus according to claim 1, wherein said first and second modulating means each receive an ultrasonic frequency carrier signal and said first modulating means frequency-modulates said audio signal into a first signal that is frequency-modulated based on said ultrasonic frequency carrier signal and said second modulating means frequency modulates said audio signal into a second signal that is frequency modulated based on the ultrasonic frequency carrier signal and an inverted version of said audio signal.

3. The loudspeaker apparatus according to claim 1, wherein said ultrasonic generating means comprises a plurality of ultrasonic generating devices, said first signal being supplied to first ones of said plurality of ultrasonic generating devices, and said second signal being supplied to second ones of said plurality of ultrasonic generating devices.

4. The loudspeaker apparatus according to claim 1, further comprising a differential processing section for differentiating said audio signal and wherein an output signal of said differential processing section is supplied to one of said first modulating means and said second modulating means, and a signal obtained by inverting the polarity of said output signal of said differential processing section is supplied to the other of said first modulating means and said second modulating means.

5. The loudspeaker apparatus according to claim 4, further comprising a first circuit section for supplying a signal obtained by shifting a DC level of said output signal from said differential processing section to said first modulating means and a second circuit section for supplying a signal obtained by inverting the polarity and shifting the DC level of said output signal from said differential processing section to said second modulating means.

6. The loudspeaker apparatus according to claim 5, further comprising:

preprocessing means for preprocessing said audio signal;

a first amplitude-modulation section for amplitude-modulating an output signal of said preprocessing means using the output signal of said first modulating means as a carrier wave; and a second amplitude-modulation section for amplitude-modulating the output signal of said preprocessing means using the output signal of said second modulating means as a carrier wave.

7. The loudspeaker apparatus according to claim 6, wherein said preprocessing means includes a first signal processing section for determining an inverse cosine value of said audio signal, a second signal processing section for multiplying an output of said first signal processing section by ½, and a third signal processing section for determining a cosine value of an output of said second signal processing section.

8. The loudspeaker apparatus according to claim 6, wherein said preprocessing means includes a first signal processing section for adding a DC offset to said audio signal, a second signal processing section for multiplying an output of said first signal processing section by ½, and a third signal processing section for determining a square root of an output of said second signal processing section.

9. The loudspeaker apparatus according to claim 6, wherein said preprocessing means includes a first signal processing section for adding a DC offset to said audio signal and a second signal processing section for determining a square root of an output of said first signal processing section.

10. The loudspeaker apparatus according to claim 6, further comprising a correction filter arranged between said first and second modulating means and said ultrasonic generating means.

11. The loudspeaker apparatus according to claim 10, wherein said correction filter suppresses resonance frequency components of the ultrasonic generating means in said first and second output signals of said first and second modulating means.

12. The loudspeaker apparatus according to claim 10, wherein said correction filter has characteristics inverse to characteristics of said loudspeaker apparatus at least in a frequency band where outputs of said first and second amplitude-modulation sections spread.

13. The loudspeaker apparatus according to claim 1, further comprising a high-pass filter arranged between said first and second modulating means and said ultrasonic generating means.

14. The loudspeaker apparatus according to claim 13, further comprising a correction filter arranged between said first and second modulating means and said high-pass filter.

15. The loudspeaker apparatus according to claim 14, wherein said correction filter suppresses resonance frequency components of the ultrasonic generating means in said output signal of said first and second modulating means.

16. A loudspeaker apparatus comprising:

first modulating means for frequency-modulating an audio signal and producing a first output signal of a frequency band higher than an audible frequency band;

second modulating means including an inverter for frequency modulating the audio signal and producing a second output signal of a frequency band higher than the audible frequency band;

correction means receiving the first and second output signals from said first and second modulating means and producing corrected output signals; and ultrasonic generating means driven by the corrected output signal of said correction means for producing ultrasonic waves.

17. The loudspeaker apparatus according to claim 16, wherein said correction means comprises a filter for suppressing resonance frequency components of the ultrasonic generating means in said first and second output signals of said first and second modulating means.

18. A loudspeaker apparatus comprising:

modulating means including a first modulating section and a second modulating section, one of said first modulating section and said second modulating section being supplied with an audio signal, the other of said first modulating section and said second modulating section being supplied with a signal obtained by inverting said audio signal, whereby said audio signal is frequency-modulated into a signal of a frequency band higher than an audible frequency band; and ultrasonic generating means driven by an output signal of said modulating means, wherein said ultrasonic generating means includes a first generating section including a first plurality of ultrasonic generating devices driven by an output signal of said first modulating section and a second generating section including a second plurality of ultrasonic generating devices driven by an output signal of said second modulating section.

19. The loudspeaker apparatus according to claim 18, further comprising a bypass filter arranged between said modulating means and said ultrasonic generating means.

20. The loudspeaker apparatus according to claim 19, further comprising an inverse circuit section for inverting an amplitude of said audio signal.

21. The loudspeaker apparatus according to claim 18, wherein said first and second modulating sections perform frequency modulation using a same carrier wave.

22. The loudspeaker apparatus according to claim 18, wherein said ultrasonic generating means comprises a piezoelectric device.

23. A method of driving a loudspeaker apparatus having an ultrasonic generating device, said method comprising:

a first step of frequency-modulating an input audio signal into a first signal of a frequency band higher than an audible frequency band;

a second step of frequency modulating the input audio signal into a second signal, inverted relative to said first signal, of a frequency band higher than the audible frequency band; and a subsequent step of driving an ultrasonic generating device by said first and second signals obtained in the first and second steps of frequency-modulating.

24. The method of driving a loudspeaker apparatus according to claim 23, wherein in said first step of frequency modulating said input audio signal is frequency-modulated into said first signal based on an ultrasonic frequency carrier signal and in said second step of frequency modulating said input audio signal is frequency modulated into said second signal based on the ultrasonic frequency carrier signal and an inverted version of said input audio signal.

25. The method of driving a loudspeaker apparatus according to claim 24, wherein said loudspeaker apparatus comprises a plurality of ultrasonic generating devices, and further comprising the steps of supplying said first signal to part of said plurality of ultrasonic generating devices, and supplying said second signal to the rest of said plurality of ultrasonic generating devices.

26. The method of driving a loudspeaker apparatus according to claim 23, comprising the further steps of differentiating said input audio signal and driving said ultrasonic generating device by said first signal obtained by frequency-modulating the differentiated input audio signal and by said second signal obtained by frequency-modulating a signal produced by inverting the polarity of the differentiated input audio signal.

27. The method of driving a loudspeaker apparatus according to claim 23, comprising the further steps of differentiating said input audio signal and driving said ultrasonic generating device by said first signal obtained by frequency-modulating a signal produced by shifting the DC level of the differentiated input audio signal and by said second signal produced by frequency modulating a signal produced by inverting the polarity and shifting the DC level of the differentiated input audio signal.

28. The method of driving a loudspeaker apparatus according to claim 23, comprising the further steps of driving said ultrasonic generating device by a first amplitude-modulated signal obtained by amplitude-modulating a signal produced by preprocessing said input audio signal using said first signal as a carrier wave and a second amplitude-modulated signal obtained by amplitude-modulating the signal produced by preprocessing said input audio signal using said second signal as a carrier wave.

29. The method of driving a loudspeaker apparatus according to claim 28, wherein said preprocessing said input audio signal includes determining an inverse cosine value of said input audio signal, multiplying the determined inverse cosine value by ½, and determining a cosine value from the halved inverse cosine value.

30. The method of driving a loudspeaker apparatus according to claim 28, wherein said preprocessing of said input audio signal includes adding a DC offset to said input audio signal, multiplying an output obtained by adding a DC offset by ½, and determining a square root from the halved DC offset input audio signal.

31. The method of driving a loudspeaker apparatus according to claim 28, wherein said preprocessing of said input audio signal includes adding a DC offset to said input audio signal and determining a square root of an output obtained by adding a DC offset.

32. The method of driving a loudspeaker apparatus according to claim 28, further comprising a step of suppressing resonance frequency components of the ultrasonic generating device out of said first and second amplitude-modulated signals.

33. The method of driving a loudspeaker apparatus according to claim 28, further comprising the step of correcting said first and second amplitude-modulated signals by a filter having characteristics inverse to characteristics of said loudspeaker apparatus at least in a frequency band where outputs of said first and second amplitude-modulating sections spread.

34. The method of driving a loudspeaker apparatus according to claim 23, further comprising the step of supplying said first and second signals to said ultrasonic generating device by way of respective first and second high-pass.

35. The method of driving a loudspeaker apparatus according to claim 34, further comprising a step of suppressing resonance frequency components of the ultrasonic generating device in said first and second signals.

* * * * *